US011027511B2

(12) United States Patent
Chan et al.

(10) Patent No.: US 11,027,511 B2
(45) Date of Patent: Jun. 8, 2021

(54) SHEET STOCK MATERIAL CONFIGURATION AND APPARATUS, SYSTEMS AND METHODS FOR FEEDING SHEET STOCK MATERIAL TO A DUNNAGE SYSTEM

(71) Applicant: Nuevopak Technology Company Limited, Kowloon (HK)

(72) Inventors: Simon C. S. Chan, Hong Kong (HK); Wen Yong Jiang, Fo Shan (CN)

(73) Assignee: Nuevopak Technology Company Limited, Kwun Tong (HK)

( * ) Notice: Subject to any disclaimer, the term of this patent is extended or adjusted under 35 U.S.C. 154(b) by 111 days.

(21) Appl. No.: 16/086,976

(22) PCT Filed: Mar. 20, 2017

(86) PCT No.: PCT/US2017/023264
§ 371 (c)(1),
(2) Date: Sep. 20, 2018

(87) PCT Pub. No.: WO2017/165321
PCT Pub. Date: Sep. 28, 2017

(65) Prior Publication Data

US 2019/0099975 A1 Apr. 4, 2019

Related U.S. Application Data

(60) Provisional application No. 62/314,379, filed on Mar. 28, 2016.

(30) Foreign Application Priority Data

Mar. 21, 2016 (CN) ..... 201610161068.7

(51) Int. Cl.
*B31D 5/00* (2017.01)
*B65H 20/16* (2006.01)

(52) U.S. Cl.
CPC ..... *B31D 5/0047* (2013.01); *B65H 20/16* (2013.01); *B31D 2205/0035* (2013.01);
(Continued)

(58) Field of Classification Search
CPC ..... B31D 5/0047; B31D 2205/0035; B31D 2205/0047; B31D 2205/0064;
(Continued)

(56) References Cited

U.S. PATENT DOCUMENTS 1,989,794 A 2/1935 Duvall
2,156,501 A * 5/1939 Katz ..... B29D 7/01 428/121

(Continued)

FOREIGN PATENT DOCUMENTS

JP 2003-175932 A 6/2003
WO 2016/044767 A1 3/2016
WO 2016/183566 A1 11/2016

*Primary Examiner* — Nathaniel C Chukwurah
*Assistant Examiner* — Lucas E. A. Palmer
(74) *Attorney, Agent, or Firm* — Seed IP Law Group LLP

(57) ABSTRACT

Methods and structures are provided for a dunnage system to facilitate efficient coupling together of supply units of pre-configured sheet stock material, such as, for example, separate units of fanfold stacks of pre-configured sheet stock material, in a manner of continuous supply with a continuous pocket extending longitudinally between the separate supply units, so that they can interact with an expander of the dunnage system without disruption as one supply unit is depleted and a next supply unit is fed through the dunnage system. Also, various methods, apparatus, and systems are provided to facilitate smooth operation of a dunnage machine of the dunnage system to reduce a tendency of the pre-configured sheet stock material to jam and to increase the tendency of dunnage product generated to reflect a desired shape and stability.

19 Claims, 19 Drawing Sheets

(52) U.S. Cl.
CPC ..... *B31D 2205/0047* (2013.01); *B31D 2205/0064* (2013.01); *B31D 2205/0082* (2013.01); *B65H 2701/11231* (2013.01); *B65H 2801/63* (2013.01)

(58) Field of Classification Search
CPC ..... B31D 2205/0082; B65H 20/16; B65H 2701/11231; B65H 2801/63
USPC ..... 493/395
See application file for complete search history.

(56) References Cited

U.S. PATENT DOCUMENTS 2,181,117 A * 11/1939 Brenn ..... B65H 45/12 493/324
3,845,948 A * 11/1974 Furbeck ..... B65H 29/00 270/40
4,026,198 A 5/1977 Ottaviano
4,101,026 A * 7/1978 Bonk ..... B65D 43/169 206/205
4,240,854 A 12/1980 Massey
4,247,289 A * 1/1981 McCabe ..... F16F 1/3605 493/386
4,725,469 A * 2/1988 Summerfield ..... B65H 45/24 428/43
4,750,896 A * 6/1988 Komaransky ..... B31D 5/0047 493/357
4,824,426 A * 4/1989 DuFresne ..... B65H 45/24 270/39.06
5,036,977 A * 8/1991 Schofield ..... B65H 21/00 206/389
5,558,923 A * 9/1996 Vesamaa ..... B31D 5/006 428/137
5,593,755 A * 1/1997 Fuss ..... B31D 5/04 156/204
5,740,983 A * 4/1998 Earle ..... G03D 13/005 242/348.3
5,882,767 A * 3/1999 Simmons, Jr. ..... B31D 5/0047 206/449
5,899,842 A * 5/1999 Di Pilla ..... B31D 5/00 493/399
6,015,374 A * 1/2000 Murphy ..... B31D 5/0047 493/352
6,168,847 B1 * 1/2001 Murphy ..... B31D 5/0047 206/814
6,183,586 B1 2/2001 Heidelberger
6,673,185 B1 * 1/2004 Beduhn ..... B65H 45/1015 156/157
6,679,028 B2 1/2004 O'Connor
6,971,542 B2 * 12/2005 Vogel ..... A47K 10/421 206/494
7,762,939 B2 * 7/2010 George ..... G09F 3/10 493/433
7,972,258 B2 * 7/2011 Slovencik ..... B65D 81/09 493/464
8,501,302 B2 8/2013 Hau et al.
8,708,882 B2 4/2014 Chan et al.
8,757,432 B2 * 6/2014 Muntzing ..... A47K 10/421 221/48
10,625,484 B2 4/2020 Chan et al.
2002/0064625 A1 5/2002 Goers et al.
2002/0100539 A1 * 8/2002 Harding ..... B31F 5/06 156/157
2003/0139272 A1 7/2003 Simmons, Jr.
2003/0216236 A1 * 11/2003 Harding ..... B31D 5/0047 493/350
2004/0142806 A1 * 7/2004 Coppus ..... B31D 5/0047 493/350
2004/0185994 A1 9/2004 Harding et al.
2004/0200561 A1 10/2004 Lerner et al.
2005/0065009 A1 3/2005 Lu et al.
2006/0179614 A1 * 8/2006 Andreasson ..... B65H 45/1015 19/161.1
2007/0287623 A1 12/2007 Carlson et al.
2008/0014389 A1 1/2008 Wehrmann
2008/0153685 A1 * 6/2008 Cheich ..... B65D 81/05 493/381
2009/0082187 A1 3/2009 Cheich et al.
2010/0029456 A1 * 2/2010 Cheich ..... B31D 5/0043 493/464
2010/0173130 A1 7/2010 Hau et al.
2011/0262203 A1 10/2011 Yoshioka
2011/0281711 A1 11/2011 Chan et al.
2012/0035038 A1 * 2/2012 Lembach ..... B31D 5/0047 493/381
2013/0237398 A1 * 9/2013 Lintala ..... B31D 5/0043 493/464
2013/0313277 A1 * 11/2013 Stewartson ..... B31D 5/0043 221/1
2014/0155241 A1 * 6/2014 Cheich ..... B65H 45/04 493/405
2015/0014205 A1 1/2015 Yap
2015/0119224 A1 4/2015 Orsini et al.
2016/0082685 A1 * 3/2016 Chan ..... B31D 5/0043 493/464
2016/0101585 A1 * 4/2016 Park ..... B31D 5/0047 493/10
2018/0297804 A1 * 10/2018 Dominak ..... B65H 19/1852
2018/0326686 A1 11/2018 Wetsch
2018/0326691 A1 11/2018 Wetsch
2019/0099975 A1 4/2019 Chan et al.
2019/0337257 A1 * 11/2019 Cheich ..... B65H 1/28

* cited by examiner

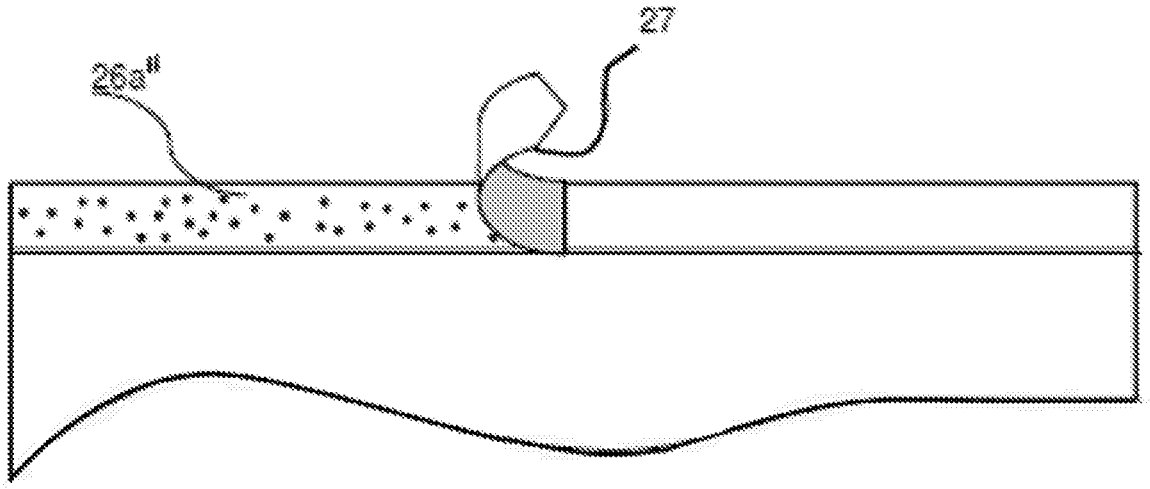
*FIG. 1c (prior art)*
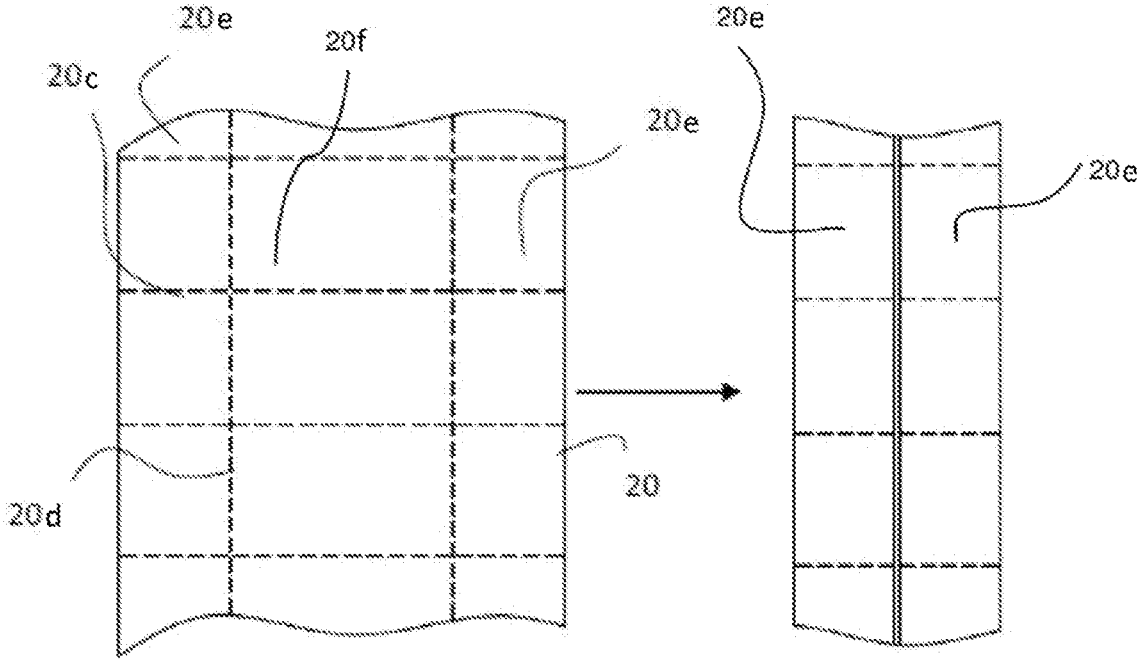
*FIG. 2a* *FIG. 2b*

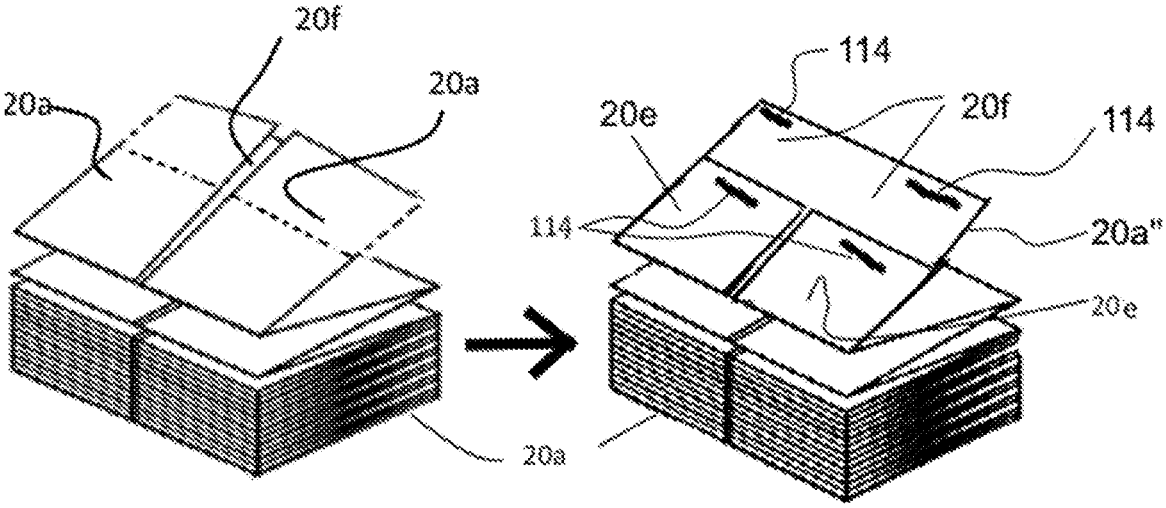
*FIG. 9c* *FIG. 9d*

SHEET STOCK MATERIAL CONFIGURATION AND APPARATUS, SYSTEMS AND METHODS FOR FEEDING SHEET STOCK MATERIAL TO A DUNNAGE SYSTEM

CROSS REFERENCE TO RELATED APPLICATION(S)

This application claims priority to Chinese application No. 201610161068.7 filed on Mar. 21, 2016, and U.S. Provisional Patent Application Ser. No. 62/314,379, filed on Mar. 28, 2016, both of which are incorporated herein by reference in their entireties.

BACKGROUND

1. Technical Field

The present disclosure relates generally to stock material configuration for dunnage systems, and apparatus and methods for feeding stock material into dunnage systems to generate cushioning material and/or void fill materials.

2. Related Art

U.S. Pat. Nos. 8,501,302 and 8,708,882 show example prior art dunnage systems, which are helpful for providing context for understanding the present disclosure, both of which patents are incorporated herein by reference in their entireties.

FIGS. 1*a*-1*c* show a prior art dunnage system 2*b* having a feed system that utilizes fanfold stacks 26*a*, 26*b* of stock material. FIG. 1*a* illustrates a trailing or "fresh" fanfold stack 26*a* having an adhesive or tape 26*a*" on a beginning (top) section, used in a method of replenishing stock material 26. A finishing section 26*b*' of an almost depleted supply of stock material 26*b* (leading supply), is connected to a beginning section 26*a*' of a fresh supply of stock material 26*a* (trailing supply), by taping or otherwise adhering, the beginning section of the fresh/trailing supply to the finishing end section of the almost depleted/leading supply. This helps prevent the necessity to re-prime the dunnage machine, or re-connect the beginning section of a fresh stock material supply to the dunnage machine, which can be time consuming. Instead, by joining the stock material supply together (e.g., fanfold stacks, or paper rolls), re-priming of the dunnage machine can be avoided because the almost depleted, leading supply will pull the fresh trailing supply into primed configuration as if the depleted leading supply had not been depleted at all.

Still referring to FIG. 1*a* (prior art), in the prior art, a user can lift a leading fanfold stack 26*b* in a tray 4, so that a trailing (fresh) fanfold stack 26*a* can be placed beneath it, and connected to the leading stack as described above. Also, the trailing fanfold stack 26*a* has a beginning section edge that is lined with an adhesive 26*a*". As shown in FIG. 1*c* (prior art), the edge of the beginning section of the fresh stack and/or the edge of the finishing section of the leading stack is lined with an adhesive strip 26*a*", which can be covered with a peel-away liner strip 27 when delivered to a user, to preserve the adhesive qualities of the adhesive until it is ready for use. Before the trailing fanfold stack 26*a* is placed on the tray 4, the liner 27 can be peeled away from the adhesive 26*a*" to expose it. Thereafter, once the trailing fanfold stack 26*a* is placed on the tray 4, the beginning edge having the adhesive 26*a*" can be attached to a bottom finishing end section of the leading fanfold stack 26*b*. Once the leading stack 26*b* is depleted, the immediately trailing stack 26*a* will be pulled into a feed of the dunnage system. Using this method, two or more stacks can be connected. That is, if a third stack is placed below the trailing stack mentioned above, then the third stack is a trailing stack relative to the stack immediately above it, and the stack immediately above it is a leading stack relative to the third trailing stack, and so on, and so forth.

BRIEF SUMMARY

Some embodiments of the present disclosure include a method of feeding pre-configured sheet stock material (provided in pre-configured sheet stock supply units) to a dunnage machine while establishing a continuous pocket formed between a longitudinally extending middle section, and a pair of longitudinally extending outer sections which are folded inward (e.g., folded about a pair of corresponding longitudinally extending perforation lines) over all or a portion of an inward face of the middle section.

In some embodiments, the pre-configured sheet stock supply unit is provided in the fanfold stack form, as will be appreciated by those skilled in the art after reviewing this disclosure.

In some embodiments, the pre-configured sheet stock supply units conform or wrap about a pre-former (e.g., expander) to volumize the sheet stock from its flat stored form (e.g., the outer sections are folded flat against the middle sections in a fanfold stack), by way of opening up the continuous pocket as the pre-configured sheet stock material from the supply unit is pulled through a dunnage machine. For example, during loading or priming a dunnage machine using the pre-configured sheet stock material, a user unfolds a leading portion of pre-configured sheet stock material in a sheet stock supply unit by lifting the outer sections (the outers sections that are folded against the middle section in the pre-configured sheet stock material) away from the middle section to expose the leading portion of the continuous pocket and wraps the sheet stock material about the expander within the pocket (e.g., the middle sections are positioned below an expander while the outer sections are wrapped about a pair of side saddle portions of the expander an curl inward within a central sunken region of the expander). Thereafter, a leading edge of the sheet stock material is connected to a forming member and can be pulled over the expander so that the pre-configured sheet stock material continues to flow over the expander as it is pulled in the wrapped configuration as described above. In this way, the pre-configured sheet stock material continues to receive the expander within the continuous pocket of the pre-configured sheet stock supply unit.

In some embodiments, structures and methods are provided to impart a continuous pocket between a chain of pre-configured sheet stock supply units that are spliced (out otherwise coupled) together to avoid disrupting flow of the sheet stock material to the dunnage machine (including the dunnage machine expander). One method of coupling the pre-configured sheet stock supply units together so that the pocket is continuous is to concentrically place a finishing section of a leading pre-configured sheet stock supply unit within a pocket of a beginning section of a trailing pre-configured sheet stock supply unit, and adhere the exterior of the finishing section to the interior of the beginning section, or vice versa.

In some embodiments, methods and structure are provided so that user will not need to place the finishing sections within the beginning section or vice versa, in order to provide a continuous pocket between pre-configured sheet stock supply units that are coupled together. In some embodiments, this can be provided by, for example, modifying the finishing section and beginning section. In particular, and for example, since the pre-configured sheet stock supply unit described herein includes a longitudinally extending middle section and longitudinally extending outer sections, with the outer sections having been pre-folded inwardly over the middle section, the outer sections obscure at least part of an inward face of the middle section and the middle sections obscure inward faces on each of the outer sections. Some embodiments of the present disclosure comprise providing a modified finishing section (e.g., a last, or bottom layer, or portion thereof, in a fanfold stack) on a leading pre-configured sheet stock supply unit which exposes a portion of each inward face of the outer sections such that the inward faces are exposed downward (in the case of stacking separate fanfold stacks vertically to feed them to a dunnage machine in series) and providing a modified beginning section (e.g., first layer, or upper layer, or portion thereof, in a fanfold stack) on a trailing pre-configured sheet stock supply unit which exposes a portion of the middle section facing upward (in the case of stacking separate fanfold stacks vertically to feed them to a dunnage machine in series) which is otherwise obscured by the overlapping outer sections, to the finishing section of the leading fanfold stack. These modifications of the present disclosure can be imparted by cutting away a portion of middle section or a portion of outer section, respectively, or by folding a portion of the sections, as described herein in association with illustrative drawings by way of example. Thereafter, coupling the leading pre-configured sheet stock supply unit to the trailing pre-configured sheet stock supply unit, while providing a continuous pocket between the two supply units, can comprise simply aligning and abutting the last layer in a leading stack (e.g., modified finishing section) with a first layer in a trailing stack (e.g., modified beginning section), with adhesive provided on respective surfaces before aligning and abutting the respective stacks.

In some embodiments, the methods comprise stacking a first pre-configured sheet stock supply unit atop a second pre-configured sheet stock supply unit, wherein the first pre-configured sheet stock supply unit is coupled to the second pre-configured sheet stock supply unit as a result of the stacking by adhesive contact between the respective sheet stock supply units when they are stacked, and wherein a continuous pocket aligns between the respective sheet stock supply units as a result of the first pre-configured sheet stock supply unit being coupled to the second pre-configured sheet stock supply unit by the stacking.

Some embodiments of the present disclosure comprise methods of feeding sheet stock material to a dunnage machine, and in particular, methods for loading a pre-configured sheet stock material on an expander. The methods comprise providing a pre-configured sheet stock supply unit having a plurality of lateral perforation lines and at least one longitudinal perforation line and connecting the pre-configured sheet stock supply unit to an expander of a dunnage machine by lifting at least one longitudinal section of the pre-configured sheet stock supply unit at a leading portion thereof to unfold the at least one longitudinal section about the at least one longitudinal perforation line, whereby the expander may be received within a pocket formed by the at least one longitudinal section and another longitudinal section separated by the at least one longitudinal perforation line.

In some embodiments, a supply unit of pre-configured sheet stock material for a dunnage machine is provided including at least one middle longitudinal section and at least one laterally folded longitudinal section, wherein a beginning section or finishing section of the supply unit comprises either the at least one laterally folded longitudinal section extending longitudinally further than the at least one middle longitudinal section or the at least one middle longitudinal section extending longitudinally further than the at least one laterally folded longitudinal section. Moreover, in some embodiments, both the beginning section and finishing section have at least section extending longitudinally further than at least another section. Also, in some embodiments, the beginning section has at least one middle longitudinal section extending longitudinally further than at least one laterally folded longitudinal section, and the finishing section has the at least one laterally folded longitudinal section extending longitudinally further than the at least one middle longitudinal section.

In some embodiments, a connected chain of fanfold feed stock supply units for a dunnage machine is provided comprising a leading supply unit having a finishing section and a trailing supply unit having a beginning section, wherein the leading supply unit and trailing supply unit each include at least one longitudinally extending fold line about which at least one longitudinal section of the supply unit is laterally folded against another longitudinal section of the supply unit, and wherein the beginning section includes the at least another longitudinal section extending longitudinally forward of the at least one longitudinal section.

In some embodiments, a dunnage machine is provided comprising an expander, a forming member, and a motor connected to the forming member, wherein the expander comprises a left saddle portion, a right saddle portion, and a middle sunken area between the left saddle portion and the right saddle portion, and a vertically rising rearwardly sloped separator rod disposed between the left saddle portion and the right saddle portion.

BRIEF DESCRIPTION OF THE DRAWINGS

FIG. 1*c* shows a prior art sheet stock material end portion having an adhesive or tape with peel away portion for exposing an adhesive surface, used for splicing sheet stock supply units together.

FIG. 2*a* shows an embodiments of a perforated sheet stock material having both longitudinal perforation lines and lateral perforations lines.

FIG. 2*b* shows the sheet stock material of FIG. 2*a* with lateral outer sections thereof folded laterally inward about longitudinal perforation lines, to mate substantially flat against a middle section of the sheet stock material, to form a pre-configured sheet stock material.

FIGS. 9*c* & 9*d* are perspective views showing an alternative embodiment of a modification of a beginning section of a trailing fanfold stack for some alternative embodiments of the present disclosure, the stack being pre-configured, with the beginning section thereof having been modified in FIG. 9*d* by the cuts made in FIG. 9*c*.

DETAILED DESCRIPTION

In the following description, certain specific details are set forth in order to provide a thorough understanding of various embodiments of the disclosure. However, upon reviewing this disclosure one skilled in the art will understand that the disclosure may be practiced without many of these details. In other instances, well-known or widely available machine parts, dunnage system components, or stock materials used in creating cushioning and/or void fill products have not been described in detail to avoid unnecessarily obscuring the descriptions of the embodiments of the present disclosure.

In the present description, inasmuch as the terms "about," "substantially," "approximately," and "consisting essentially of" are used, they mean±20% of the indicated range, value, or structure, unless otherwise indicated. It should be understood that the terms "a" and "an" as used herein refer to "one or more" of the enumerated components. The use of the alternative (e.g., "or") should be understood to mean either one, both, or any combination thereof of the alternatives, unless expressly indicated otherwise. As used herein, the terms "include" and "comprise" are used synonymously, both of which are intended to be construed in a non-limiting sense, as are variants thereof, unless otherwise expressly stated.

Various embodiments of the present disclosure are described for purposes of illustration, in the context of use with paper-based sheet stock materials for dunnage formation. However, as those skilled in the art will appreciate upon reviewing this disclosure, other materials may also be suitable. Throughout this disclosure, unless otherwise indicated, the term "sheet" can refer to single-ply material, but can also refer to multi-ply material, with each "sheet" having multiple layers comprising thinner sheets.

Figure 2C:
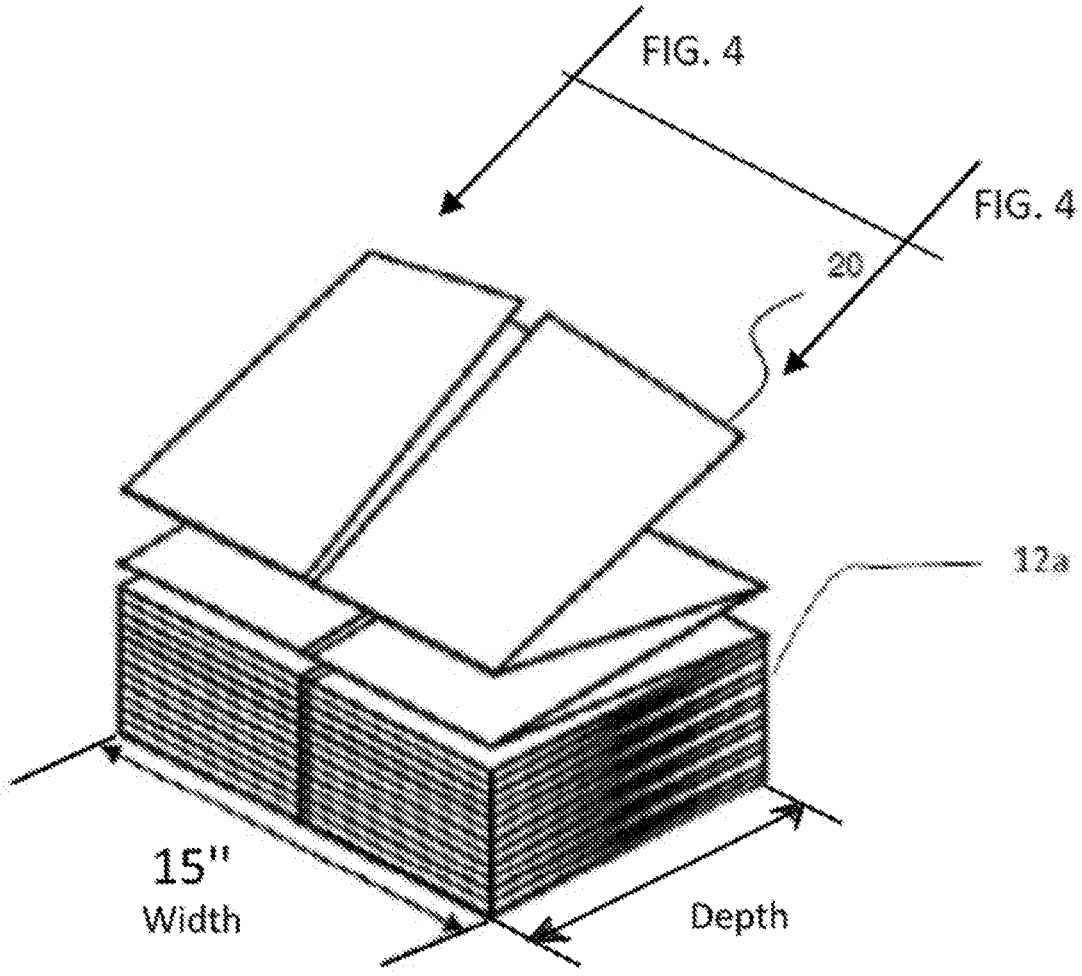
FIG. 2*c* shows a fanfold stack of pre-configured sheet stock material, formed of the perforated sheet stock material in FIGS. 2*a* and 2*b* having laterally folded portions folded about longitudinal perforation lines and longitudinally folded portions (forming the stack) folded about lateral perforation lines. In some alternative embodiments, the pre-configured sheet stock material shown in FIG. 2*c* does not include perforations, and the folds as described immediately above are provided about unperforated fold lines.

Referring to FIGS. 2*a*-2*c*, in some embodiments of the present disclosure, a fanfold stack 12*a* is formed from a continuous longitudinally extending sheet of perforated stock material, or perforated paper 20. Here, longitudinally refers directionally to an axial length extending from a trailing end (e.g., bottom end) of the fanfold stack to a leading end of a fanfold stack (e.g., top end), across multiple folded layers, as opposed to laterally (e.g., width wise) across any folded layer.

In some embodiments, the perforations, represented by dashed lines in FIG. 2*a*, can each extend entirely through multiple layers of material if the sheets are multi-ply, or can extent partially through the sheets. In some embodiments, the perforations may have different shapes, such as, for example, circular perforations, or slots. As best seen in FIG. 2*a*, in some embodiments, laterally extending perforation lines 20*c* (comprised of a plurality of aligned perforations) and longitudinal perforation lines 20*d*, can be provided in spaced apart fashion throughout the stock material folded in a fanfold stack 12*a* (or wound in a roll), which can be a continuous longitudinally extending sheet of perforated paper 20 (e.g., no completely separated sheet sections exist from the beginning of the stack to the end of the stack, or from the beginning of a roll of stock material to the end of the roll).

Referring to FIGS. 2*a* and 2*b*, in some embodiments, laterally separate longitudinally extending sections 20*e* (outside sections 20*e*) are defined by longitudinal perforation lines 20*d*. The longitudinal perforation lines 20*d* can extend longitudinally throughout the fanfold stack 12*a* (or a roll) of stock material. The stock material 20 can be folded laterally inward about the longitudinal perforation lines 20*d* to pre-configure the stock material 20. In particular, for example, the outside sections 20*e*, separated by a middle longitudinally extending section 20*f* (middle section 20*f*), of the stock material 20 can be folded inward about the longitudinal perforation lines 20*d*, to overlap the middle longitudinally extending section 20*f*, to form laterally folded sections 20*e*. The laterally folded sections 20*e* can be longitudinally continuous on both sides of the longitudinally extending stock material 20, throughout a fanfold stack 12*a* or roll or stock material 20. This laterally folded configuration for the stock material can be referred to as pre-configuration herein, or the stock material configured in this manner can be referred to as pre-configured stock material.

Referring to FIG. 2*c*, in some embodiments of the present disclosure, the pre-configured stock material 20 of FIG. 2*b* can be used to generate a fanfold stack 12*a* of pre-configured stock material, which can be used for feed to a dunnage system for generating dunnage, or cushioning/void—fill materials.

Figure 3:
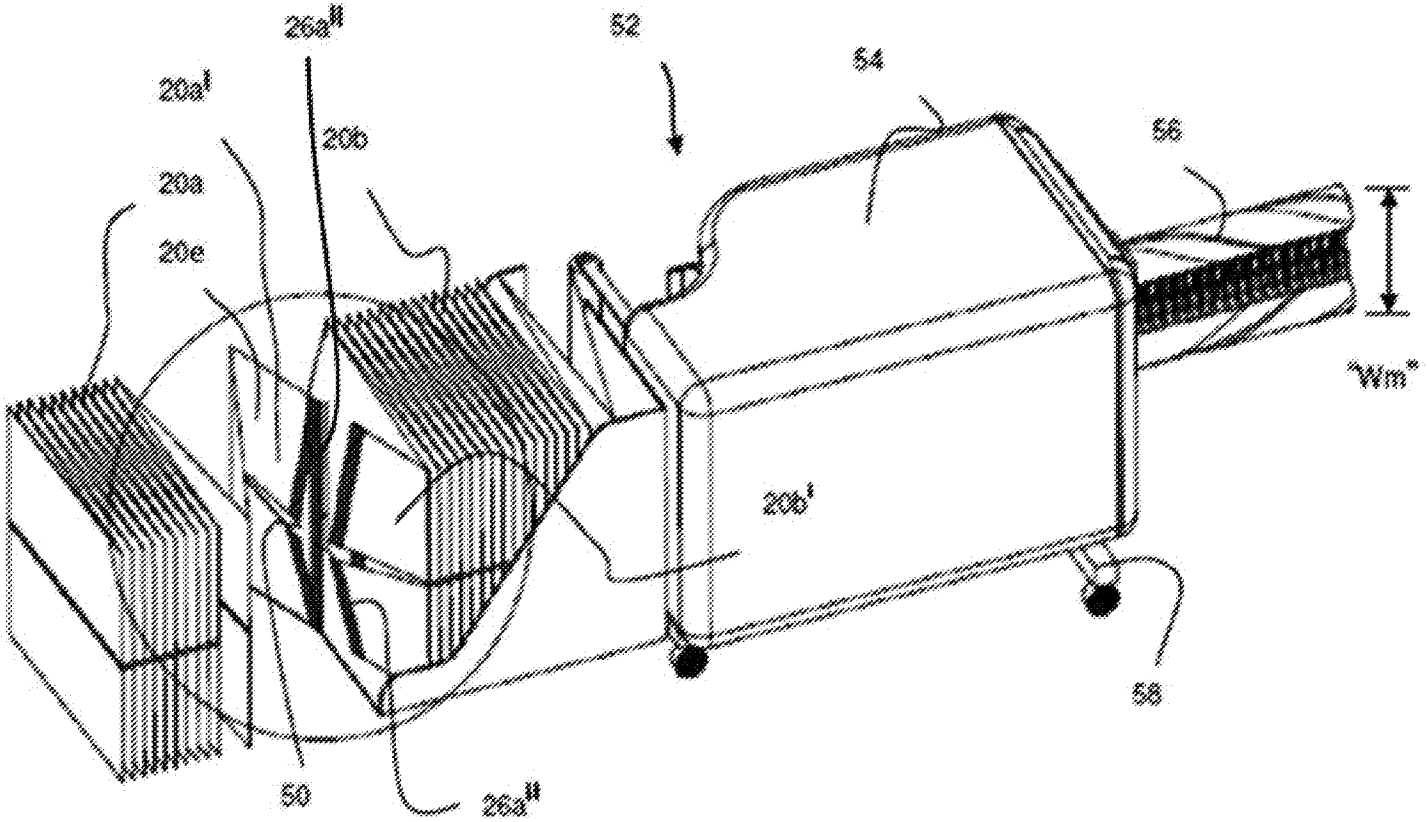
FIG. 3 shows an example dunnage system of the present disclosure including adhesive disposed on end portions of pre-configured fanfold stacks of sheet stock material, for use in splicing the fanfold stacks together by concentrically inserting an end portion of one fanfold stack concentrically within the end portion of a next fanfold stack within a pocket of the next fanfold stack, and using the adhesive to maintain the coupling to create a chain of fanfold stacks with a continuous pocket throughout the chain, the pocket being a space between the inwardly folded outer sections and the middle section of each pre-configured fanfold stack.

As shown in FIG. 3, in some embodiments of the present disclosure, multiple fanfold stacks, including a trailing fanfold stack 20*a*, and a leading fanfold stack 20*b*, can be pre-configured and provided with adhesive strip sections 26*a*" at a beginning edge of a beginning section 20*a*' for the trailing stack 20*a*, and at a finishing edge of a finishing section 20*b*' for a leading stack 20*b*. The adhesive strip sections 26*a*" can be provided on opposite facing outside walls of the stock material 20. As such, the beginning section 20*a*', or finishing section 20*b*', can be inserted into a pocket 50 of the other section, namely, the pocket 50 formed between the laterally folded sections 20*e* and the unfolded middle section 20*f* (See, e.g., FIG. 2*a*). An adhesive strip section 26*a*" on the outside surface of the insertion section can contact and bind to an inside wall surface of the other section within its receiving pocket 50.

Figure 1A:
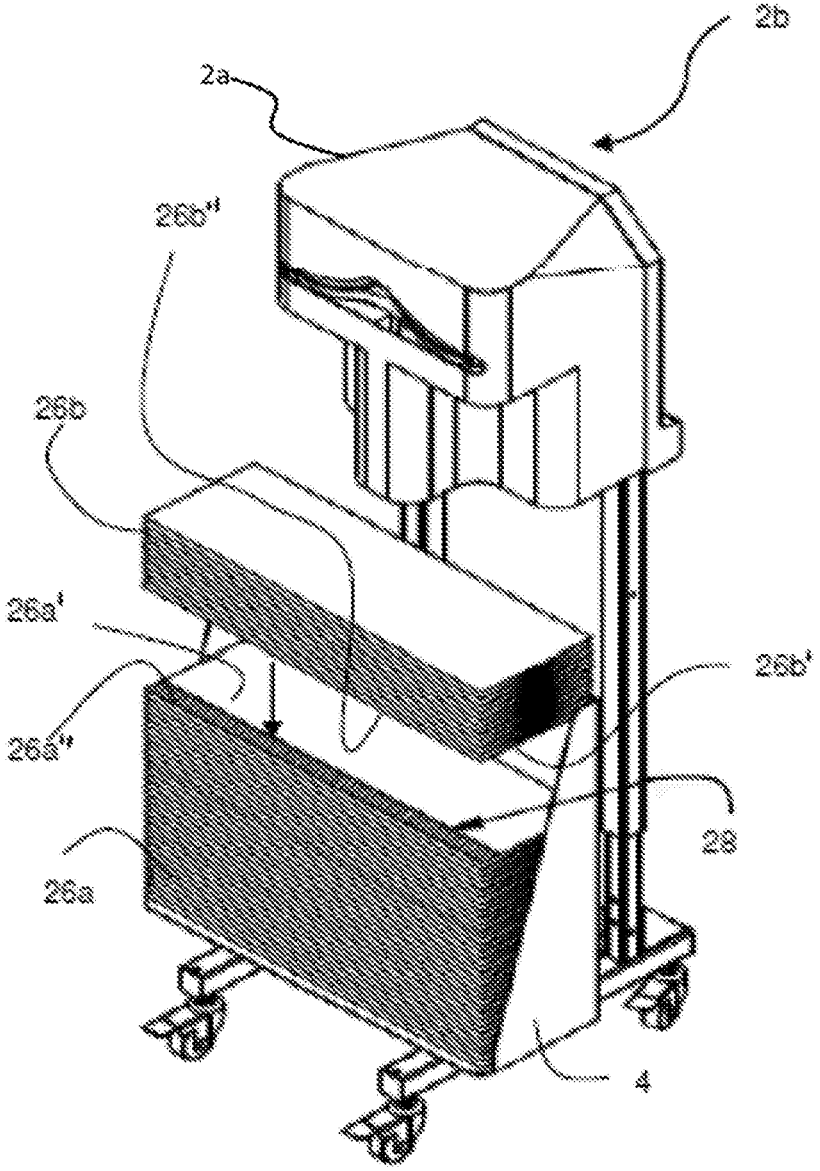
FIG. 1a (prior art)
FIGS. 1*a* & 1*b* show prior art dunnage systems including a series of stacked fanfold sheet stock supply units.
Figure 1B:
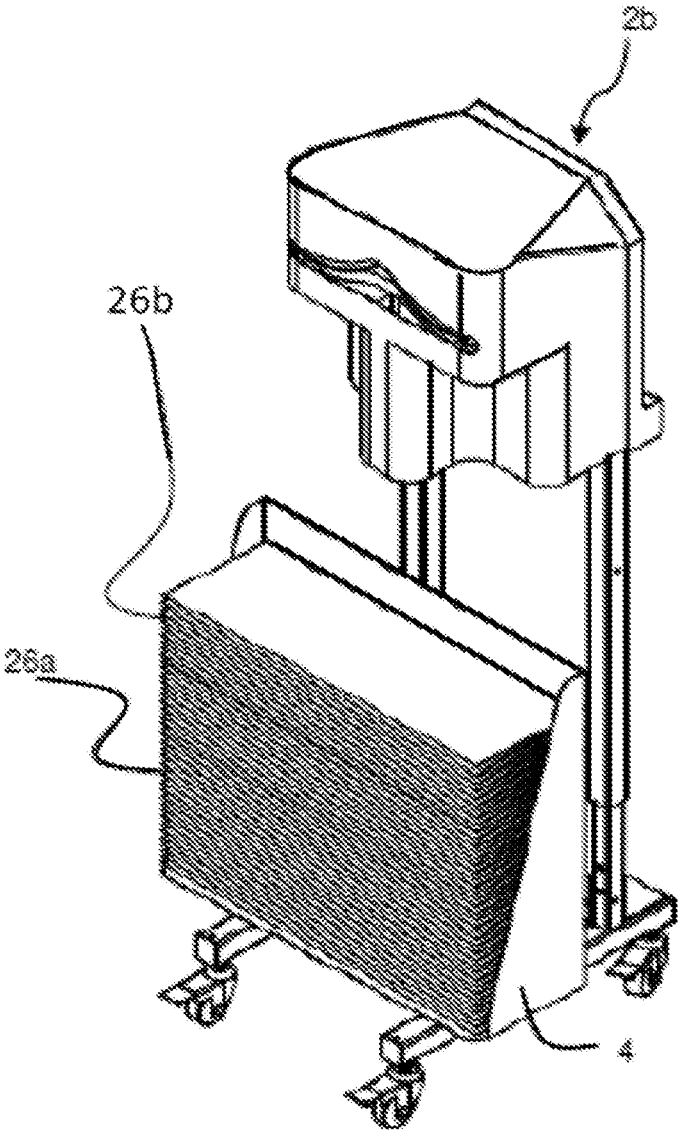
FIG. 1b (prior art)

As further disclosed by way of illustration in FIG. 3, in some embodiments, a the beginning section 20*a*' and the finishing section 20*b*' are each truncated fold layers in the respective fanfold stacks configured so as to extend only partially across the entire depth of the stack, whereas all other folded layers of the respective fanfold stacks extend the full depth (i.e., a longitudinal length of each folded layer of a fanfold stack, as indicated by the marking, "Depth," in FIG. 2*c*) of the fanfold stack, as will be appreciated by those skilled in the art after reviewing this disclosure. Similar to the embodiments shown for FIGS. 1*a*-1*c*, the arrangement described in relation to FIG. 3, helps prevent the necessity to re-prime the dunnage machine 2*a*, 54, 55 or re-connect a beginning section of a stock material supply to the dunnage machine 2*a*, 54, 55 which can be time consuming.

Figure 4:
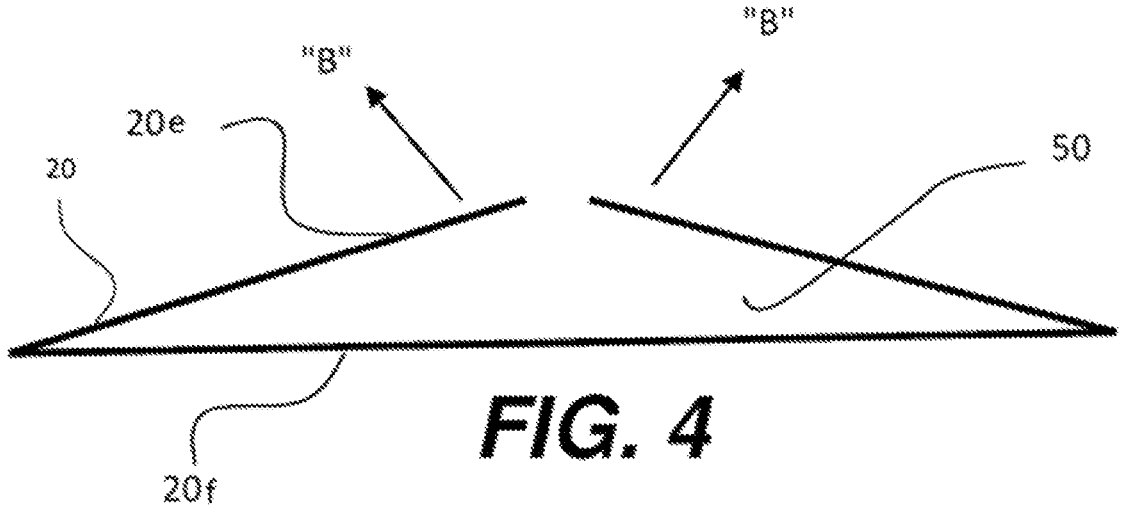
FIG. 4 shows a simplified lateral cross sectional view of a section of the pre-configured fanfold stack of FIG. 2*c* or FIG. 9*b*, and in accordance with some embodiments of the present disclosure, the outer sections having been partially lifted upward and outward (unfolded) in the directions of arrows "B" to expose, or begin to expose, a pocket for use in loading the fanfold stack on an expander.
Figure 5:
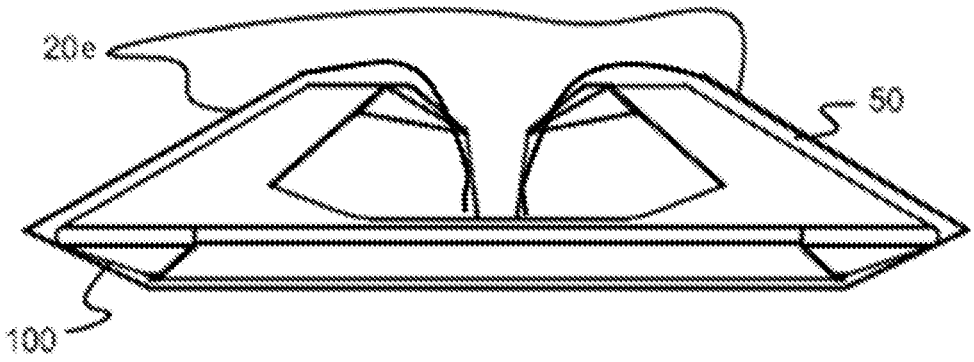
FIG. 5 shows the sheet stock material section of FIG. 4 having been wrapped about an expander for a dunnage machine, with the outer sections wrapped about saddle portions of the expander.
Figure 6:
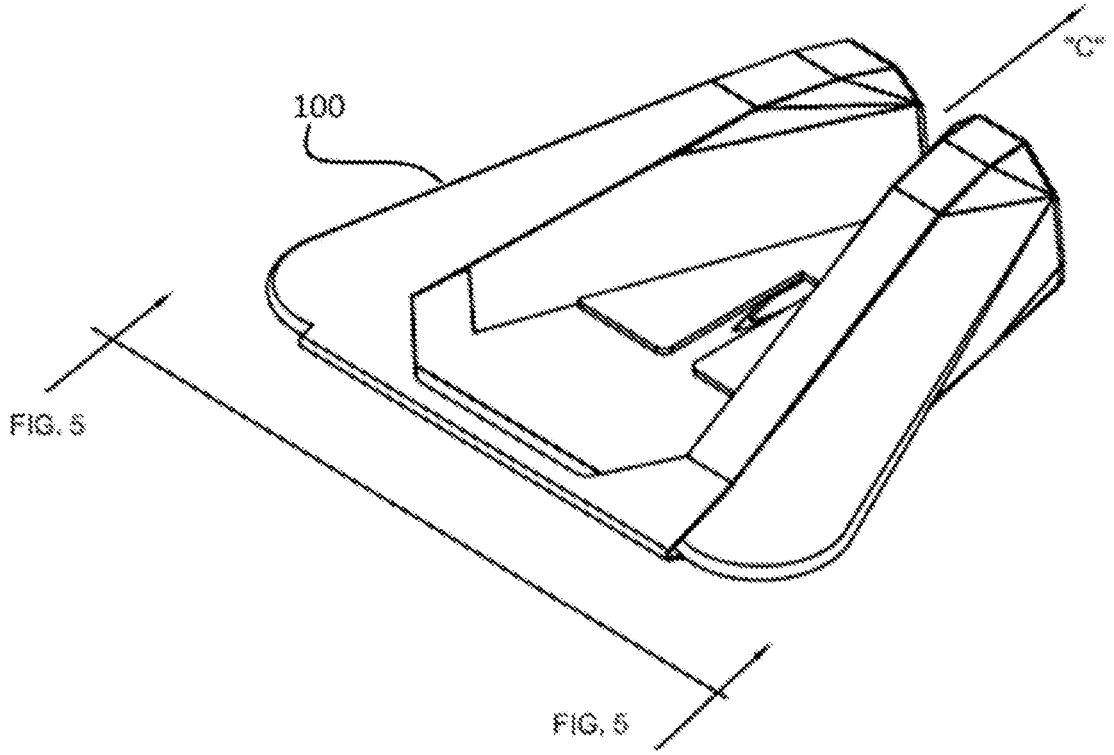
FIG. 6 shows an example preformed (or expander) of the present disclosure.

FIGS. 5 & 6 illustrate an example expander 100 of the present disclosure, which can be included as part of a dunnage machine (or dunnage system), disposed upstream of forming gears of a dunnage machine, as will be appreciated by those skilled in the art after reviewing the present disclosure. The expander 100 can assist in pre-forming stock material fed to a dunnage machine, by expanding it before it is formed by forming gears or other types of forming members within a dunnage machine 2*a*, 54. The expander 100 can be conveniently received in a pocket 50 of the pre-configured sheet stock material 20 of the fanfold stacks 12*a* (or as otherwise stated, the pre-configured sheet stock material can fit, or wrap, over the expander 100, with the expander within the pocket 50). In particular, during priming of a dunnage machine, laterally folded sections 20*e* of the pre-configured stock material can be lifted upwardly and outwardly, generally in the directions of arrows "B" in FIG. 4, so that the expander 100 in FIGS. 5 & 6, can fit generally between the laterally folded outside sections 20*e* and the middle section 20*f*. This can be undertaken for a beginning section 20*a*' of a leading supply unit of a preconfigured stock material, such as a fanfold stack or roll. The sheet stock material 20 is then pulled over the expander 100 in a forward direction, generally expressed as the direction of arrow "C" in FIG. 6, toward a forming member (e.g., a gear, of the dunnage system).

Figure 7:
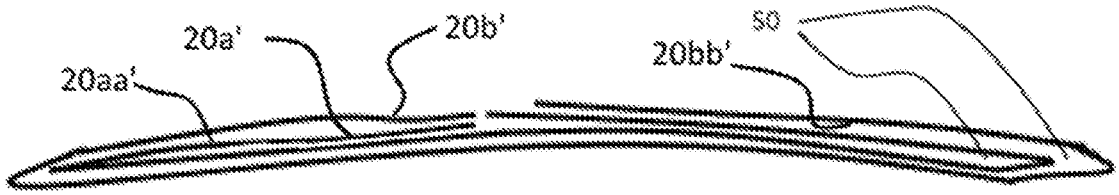
FIG. 7 shows a simplified lateral cross sectional view of a section of the pre-configured sheet stock material, such as that shown in FIG. 2*c*, having a multi-ply configuration with a pocket.
Figure 8:
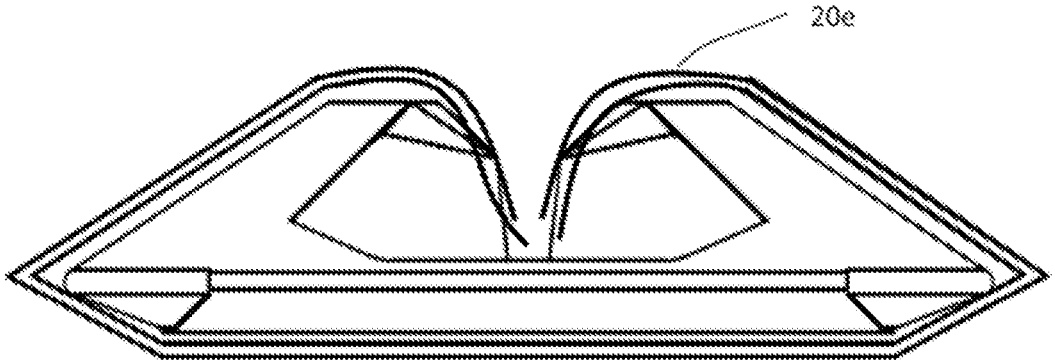
FIG. 8 shows the multi-ply section of sheet stock material of FIG. 7, wrapped about an expander of the present disclosure, in accordance with various embodiments of the present disclosure

Referring back to FIG. 3 (showing a beginning section 20*a*' of a trailing fanfold stack placed within a pocket 50 of a finishing section 20*b*' of a leading fanfold stack, or vice versa), one benefit for this arrangement in connecting the separate fanfold stacks, is to permit the pockets 50 of the successive fanfold stacks to continuously receive the expander 100 as they are pulled over the expander 100 in connected configuration, as will be appreciated by those skilled in the art after reviewing this disclosure (an expander similar, or the same, as expander 100, may be provided within the dunnage machine 2*a*, 54, or other dunnage machine, to receive the pre-configured sheet stock material, but is not illustrated within the dunnage machines 2*a*, 54 as shown in FIGS. 1 and 3, since it is obscured by the outer casing and/or other structures, as will be appreciated by those skilled in the art upon reviewing this disclosure). That is, as shown in FIG. 7, when the beginning section 20*a*' is connected to the finishing section 20*b*' within a pocket 50 if the finishing section (or vice versa, when the finishing section 20*b*' is connected to the beginning section 20*a*' within a pocket 50 of the beginning section), the pocket 50 of one of the sections 20*a*', 20*b*' opens into a pocket 50 of the other section 20*a*', 20*b*', and this allows the connected fanfold stacks to continuously receive the expander 100 within the pockets 50 (See, e.g., FIG. 8) as the sections 20*a*', 20*b*' are connected together, with the outside wall 20*aa*' of one section, being connected to the inside wall 20*bb*' of another section by an adhesive applied when loading. As such, when the fanfold stacks are connected together in this fashion, no re-priming of the dunnage machine is generally needed when a leading fanfold stack is depleted and pulled over the expander, so long as it is connected as described above to the trailing fanfold stack. However, as will be appreciated by those skilled in the art after reviewing this disclosure, it can be time consuming and difficult to connect the fanfold stacks in this manner via insertion into a pocket 50. In particular, a user needs to insert one section 20*a*' or 20*b*' within the pocket 50 of the other section 20*a*' or 20*b*', and cause an outside surface of the inserted section to adhere to an inside surface of the other section within its pocket 50.

Figures 9A, 9B:
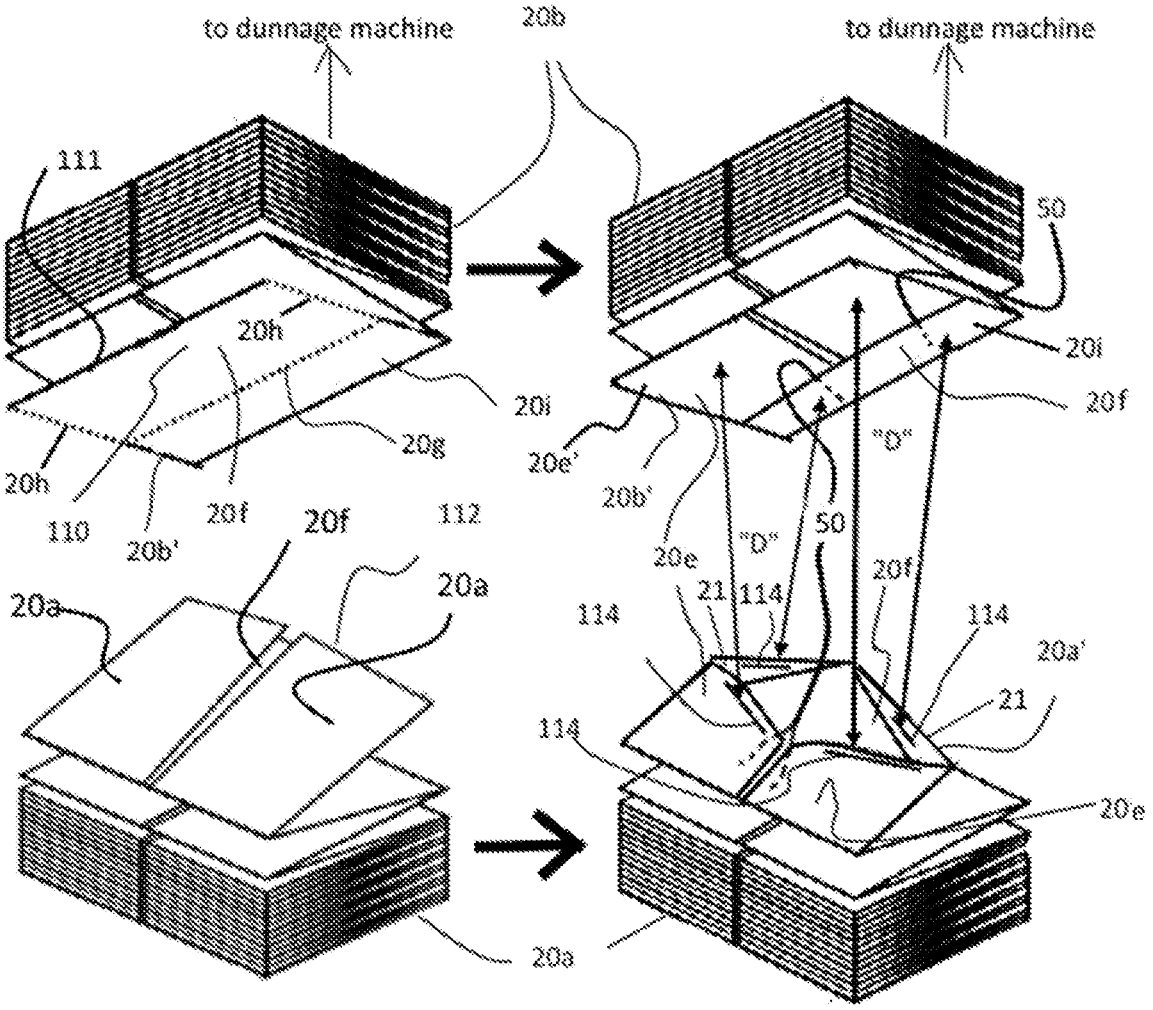
FIG. 9*a* is a perspective view showing leading and trailing fanfold stacks for some embodiments of the present disclosure, each of the stacks being pre-configured, with the leading fanfold stack including dot lines to illustrate example cuts of the present disclosure made to remove a portion of the middle longitudinal section of the fanfold stack in the finishing section thereof to form the modified finishing section in the leading fanfold stack in FIG. 9*b* (which shows both a leading fanfold stack and trailing fanfold stack of the present disclosure).
FIG. 9*b* is a perspective view showing leading and trailing fanfold stacks for some embodiment of the present disclosure, each of the stacks being pre-configured, with a modified finishing section and modified beginning section, respectively, and with the modified finishing section begin formed from the cuts shown in FIG. 9*a*, and with the modified beginning section being formed from the folds and folding process shown in FIGS. 10*a*-10*d*.

Instead of the more time consuming approach described above, in some embodiments of the present disclosure, the fanfold stacks are connected in sequence for continuous feeding via a modified beginning section 20*a*' in a trailing stack, and a modified finishing section 20*b*' in a leading stack. Referring to FIG. 9*a*, in some embodiments, a leading fanfold stack 20*b* ("leading" referring to the fanfold stack that is nearer to being formed in the dunnage machine, nearer than a "trailing" stack 20*a*) can have a finishing section 20*b*' (trailer folder layer) modified to form a modified finishing section 20*b*', shown in FIG. 9*b*. In particular, for example, a middle section 20*f* can be partially cut away and removed from a trailing edge of the finishing section 20*b*', by cutting a lateral cut 20*g* across a width of the finishing section 20*b*', and longitudinally positioned at, for example, a longitudinal midpoint (midpoint of the depth) of the finishing section 20*f*, and cutting a longitudinal cut along each crease about which left and right outer sections 20*e* are folded, from the trailing edge 111 to the lateral cut 20*g*, to form cuts 20*h*. These cuts 20*g*, 20*h*, allow a portion of the middle section labeled as 110 in FIG. 9*a*, to be completely removed from the middle section 20*f* to form the modified finishing section 20*b*' as shown in FIG. 9*b*, wherein only part of the middle section 20*f* is intact at a leading portion 20*i* thereof. A desired effect of the modified finishing section 20*b*' is to expose an inward face 20*e*' of the outer sections 20*e* in the finishing section 20*b*' that would otherwise be obscured by the middle section 20*f* in a pre-configured fanfold stack.

Referring to FIG. 9*a*, a top folded layer (or beginning section 20*a*') of the pre-configured trailing stack 20*a* can be folded in tapered configuration, without cutting, to form a modified beginning section 20*a*' of the trailing stack 20*a* shown in FIG. 9*b*. In particular, the trailing stack 20*a* configuration in FIG. 9*b* is formed from the trailing stack 20*a* configuration in FIG. 9*a* by folding a leading portion of the trailing stack longitudinally backward in two portions (further described later) near a beginning edge of the beginning section 20*a*' thereof, to expose an otherwise obscured portion of the middle section 20*f* forward of the outer sections 20*e*, which would normally be obscured by the left and right outer sections 20*e* (See, e.g., FIG. 9*a*, showing fanfold stack 20*a*, having the middle section 20*f* mostly obscured by left and right outer sections 20*e*). A desired effect of the modified beginning section 20*a*' in FIG. 9*b* is to expose portions of the middle section 20*f* facing upward in FIG. 9*b* that would otherwise be obscured by the outer sections 20*e* in a pre-configured fanfold stack.

Figure 10A:
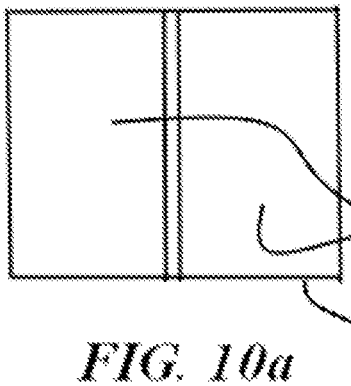
FIGS. 10*a*-10*d* are simplified views to show a folding process for some embodiments of the present disclosure by which to modify a pre-configured fanfold stack of the present disclosure to arrive at the modified beginning section of the trailing fanfold stack shown in FIG. 9*b*. The folding process shown may also be used to modify a leading portion of a pre-configured stock sheet supply unit that is not a fanfold stack.
Figure 10B:
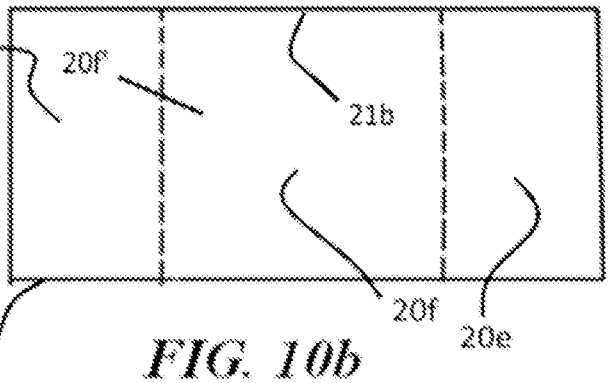
Figure 10C:
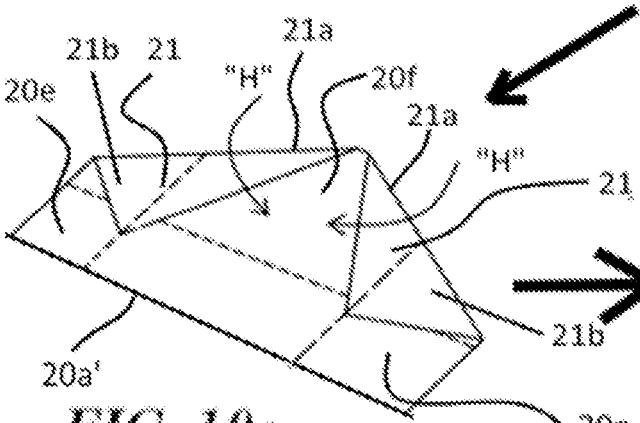
Figure 10D:
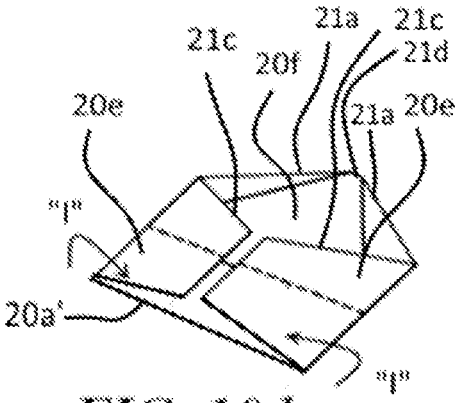

One way in which the modified beginning section 20*a*' is formed is demonstrated in FIGS. 10*a*-10*d*. For example, first, the left and right outer sections 20*e* can be folded outward to expose an inward face 20*f*' of the middle section 20*f*, as shown in FIGS. 10*a* and 10*b*. Next, referring to FIGS. 10*c* and 10*d*, triangular portions 21 of the beginning section 20*a*' can be folded longitudinally backward from a leading edge 21*b* of the beginning section 20*a*', on each lateral side thereof, until the triangular portions 21 are generally laid flat against the inward face 21*f*' of the middle section 20*f*, and inward faces of the respective left and right outer sections 20*e*. The triangular portions can be folded longitudinally backward about angled creases 21*a*, such that the creases 21*a* from a new leading edge of the middle section 20*f* in the modified beginning section in FIGS. 10*d* and 9*b*. The creases 21*a* can be angled longitudinally outwardly backward, such that the creases 21*a* from a laterally tapered leading edge of the beginning section 20*a*', with the forwardmost location 21*d* of the beginning section 20*a*' having the narrowest width of the beginning section 20*a*'. In some embodiments, the triangular portions 21 include an outer section 20*e* portion 21*b*. As such, when the triangular portions 21 are folded longitudinally backward about the crease 21*a*, the crease 21*a* also includes a reverse portion 21*c* that is angled longitudinally inwardly backward. As stated above, a desired effect of the modified beginning section 20*a*' in FIG. 9*b* and FIG. 10*d*, is to expose portions of the middle section 20*f* facing upward (relevant to FIG. 9*b* and FIG. 10*d*) that would otherwise be obscured by the outer sections 20*e* in a pre-configured fanfold stack, and another desired effect of the modified beginning section 20*a*' as illustrated thus far, is to provide for a tapered leading edge defined by crease 21*a*, having a narrow fowardmost location 21*d*. In some alternative embodiments, such as illustrated in FIGS. 9*c* and 9*d*, the modified beginning section 20*a*' could be formed by cutting away leading portions of the outer sections 20*e* along the dot-lines shown in FIG. 9*c*, to form a beginning section 20*a*" in FIG. 9*d*, also exposing portions of the middle section 2*f* that would otherwise be obscured.

As best seen in FIG. 9*b*, the exposed middle section 20*f* of the beginning section 20*a*' of the trailing stack 20*a* can be placed in direct contact with a middle longitudinal section 20*f* of the finishing section 20*b*' of the leading stack 20*b*, across an entire width of the beginning section 20*a*' and finishing section 20*b*', simply by aligning finishing section 20*b*' face to face with beginning section 20*a*', and allowing the two stacks 20*a*, 20*b*, to meet flat, or abut, with the leading stack 20*b* resting atop the trailing stack 20*a*. This is not inherent with the unmodified beginning section 20*a* and unmodified finishing section 20*b*'. Moreover, when leading stack 20*b* with modified finishing section 20*b*' is allowed to rest atop the modified beginning section 20*a*' of the trailing stack 20*a*, the inward faces 20*e*' of the outer sections 20*e* in the finishing section 20*b*' abut against the outer sections 20*e* of the beginning section 20*a*'. Again, this is not inherent with the unmodified beginning section 20*a*' and unmodified finishing section 20*b*'. The effect of this mutual abutting of middle sections 20*f* between the leading stack 20*b* and trailing stack 20*a*, and mutual abutting of the outer sections 20*a* between the leading stack 20*b* and trailing stack 20*a*, is that pockets 50 formed in each of the modified finishing section 20*b*' and modified beginning section 20*a*' will align, as best seen in FIG. 9*b*, to form a continuous longitudinal pocket 50 throughout the coupled fanfold stacks 20*a* and 20*b* (the pocket 50 of each fanfold stack being defined by inward facing walls of the outer sections 20*e* folded over the inward facing walls of the middle section 2*f*, or as otherwise stated, the space between these sections).

As best seen in FIG. 9*b*, adhesives 114 can be placed at various locations on the faces of either the modified finishing section 20*b*' or modified beginning section 20*a*', to contact and bound corresponding locations (as represented generally by arrows "D") on those sections when they are mated. That is, for example, the adhesives 114 on the triangular portions 21 of middle section 20*f* can adhere to the outward face of middle section 20*f* of the finishing section 20*b*', and the adhesives 114 on the outward face of the outer sections 20*e* of the beginning section 20*a*', can adhere to the inward faces 20*e*' of the outer sections 20*e* of the finishing section 20*b*'. As will be appreciated by those skilled in the art after reviewing the present disclosure, the adhesives 114 provided in the locations described above in combination with the modified beginning section 20*a*' and finishing section 20*b*', allow the leading stack 20*b* and trailing stack to align and abut with the leading stack atop the trailer stack, and adhere to form a continuous pocket 50 between the leading stack and trailer stack. This avoids the otherwise time consuming task of splicing a leading stack together with the trailing stack while keeping a continuous pocket, such as in the previous methods and structured described in relation to FIG. 3. As will be appreciated by those skilled in the art after reviewing the present disclosure, the adhesives 114 can be applied on alternate locations instead of those illustrated for various embodiments of the present disclosure. For example, in some embodiments, a single adhesive strip or member/surface can be applied near the tapered leading edge portion of the middle section of the modified beginning section, instead of having adhesive in multiple locations on the middle section.

This modified finishing section and modified beginning section describe immediately above, provide structures and methods for various connecting configurations between the leading stack 20*b* and trailing stack 20*a*. In some embodiments, the leading stack in a sequence of stacks, is simply rested upon the trailing or next stack, with both stacks having the modified finishing and beginning sections, and successive trailing stacks can be placed beneath the prior leading stacks (i.e., the last trailing stack in a sequence of connected stacks, etc.) to form a sequence of fanfold stacks. An adhesive 114 can be applied at the time of connection between the stacks to provide for a continuous feed, with continuous aligned pockets 50. In other embodiments, the adhesive 114 can be applied to either the finish section or beginning section to impart the adhesion between the locations described above, at any time before the respective fanfold stack is loaded into a dunnage system in a sequence of fanfold stack, such as shown in FIGS. 1 and 3. In some embodiments, the adhesive 114 is applied at the time the fanfold stack is manufactured before shipment to a customer, and the adhesive can be covered with a peel-away cover, that can be peeled off before use of the adhesive.

In other embodiments, such as shown in FIG. 3, horizontal oriented loading of feed stacks is highly desirable, and the same or similar principles would apply, with the leading stack having a modified finishing section 20*a*' being abutted against a trailing stack having a modified beginning section 20*b*', so that the stacks could be joined without having to insert a beginning section into a pocket of a finishing section, and/or vice versa, and still providing continuous aligned pockets 50.

In some embodiments, fanfold stacks can be manufactured that each of both a modified beginning section 20*a*' and modified finishing section 20*b*'. In the manner, each fanfold stack can be connected as described above in relation to FIG. 9*b* regardless of whether it is serving as trailing stack or leading stack relative to a fanfold stack to which it is being connected.

Various embodiments disclosed herein provide a convenient, effective, time efficient mechanism for connecting different supply units of pre-configured sheet stock material with laterally inwardly folded outer sections, such that a continuous pocket is formed between the connected units (e.g., fan fold stacks, or rolls of sheet stock material). In the case of rolls, the end of a roll may be required to be exposed before a modified finishing section of the roll can be connected to a modified beginning section of another roll. However, in the case of fanfold stacks, the embodiments disclosed herein can facilitate a user stacking multiple stacks of fanfold stacks and continuing to do so as stacks are depleted, keeping a continuous pocket on a continuous basis without having to re-prime the dunnage machine being fed. As such, in some embodiments, a user generally only needs to manually prime a leading stack or supply periodically, such as, for example, when there has been a jam and the dunnage machine needs to be cleared, or when initially starting to use a dunnage machine, or if the user inadvertently or intentionally runs out of connected sheet stock material supply. Priming the dunnage machine using the pre-configured stock material of the present disclosure (e.g., fanfold stacks or rolls) can comprise, among other things, lifting the laterally inwardly folded longitudinal sections 20*e* (outer sections 20*e*) at the beginning section 20*a*' to unfold them from the pre-configured shape (flat), wrapping the outer sections 20*e* about a pre-former 100 or 100' with the outer sections 20*e* surrounding a top portion of the pre-former and with the middle section 20*f* disposed beneath the pre-former (as shown in FIG. 11*a*), and connecting a forwardmost location 21*d* of the sheet stock material to a dunnage machine forming member, such as a gear 30, as explained further below.

Also, it is noted that in some embodiments, the modified beginning section and modified finishing section can be reversed in vertical orientation and serve the same or similar purpose as described above with respect to FIG. 9*b*; however, this reversal does not take into account an advantage of having the modified beginning section 20*a*' serve as a leading edge going forward into a dunnage machine. For example, as best seen in FIG. 11*a*, in some embodiments, the creases 21*a* of the modified beginning section 20*a*', allow any given fanfold stack having the modified beginning section 20*a*' to be efficiently primed in a dunnage machine, including initiating feed to a forming member of the dunnage machine, such as, for example, a gear 30. That is, the tapered configuration of the leading edge of the fanfold stack beginning section 20*a*' having a narrower fowardmost location 21*d*, compared to a full lateral width of the beginning section 20*a*', permits the fanfold stack to prime more efficiently into the dunnage machine with less frequent jamming Without a tapered leading edge portion 32, a user may need to manually scrunch (form by hand to a more narrow configuration) a front portion of the sheet stock material to initially feed it to the forming member, which can create irregular arbitrary formations at the leading edge portion 32, or otherwise feed a full width (width of the corresponding fanfold stack) leading edge portion 32 to the forming member, and in both cases, part the sheet stock material is more likely to catch on various parts of the dunnage machine and cause jamming (as opposed to a tapered leading edge portion 32) by bunching up in the dunnage machine (See, e.g., FIG. 11*c*) when the forming members are operated, as will be appreciated by those skilled in the art upon reviewing this disclosure. That is, without being bound by theory, the provision of the tapering crease 21*a*, and the folded edge portions 21, can allow the beginning section 20*a*' to be pulled into the dunnage machine while reducing a chance that a leading edge portion 32, or other portion of stock sheet material 20, with catch on a portion of the dunnage machine.

Figure 11A:
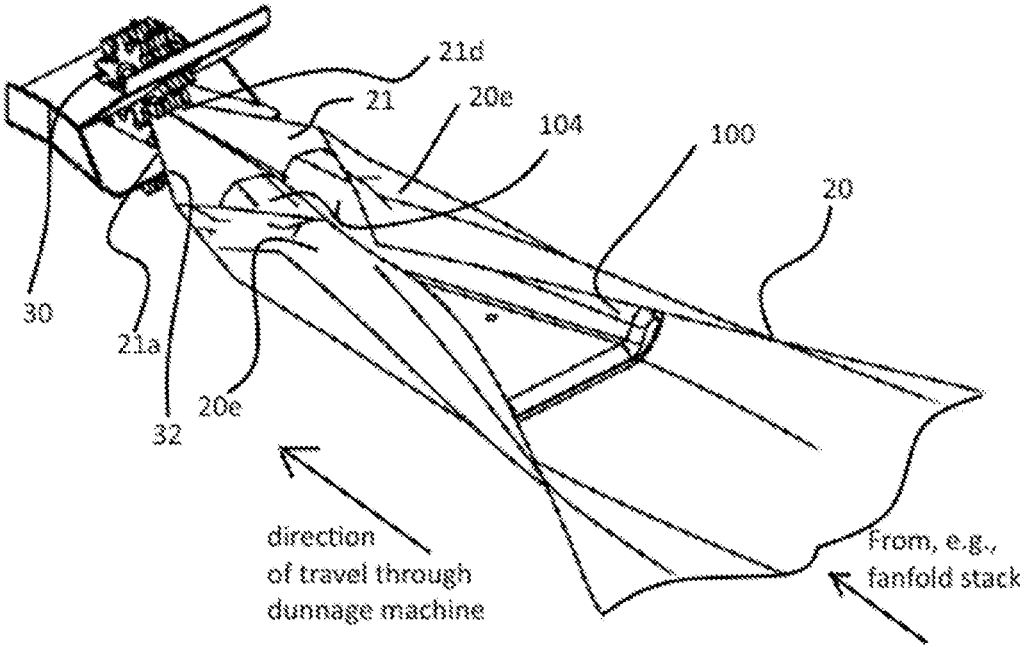
FIGS. 11*a*-11*b* show a front portion of a pre-configured stock sheet material having been primed on an expander with a tapered leading edge portion in accordance with various embodiments of the present disclosure and having been primed into a forming member that is a gear apparatus for some embodiments of the present disclosure.
Figure 11B:
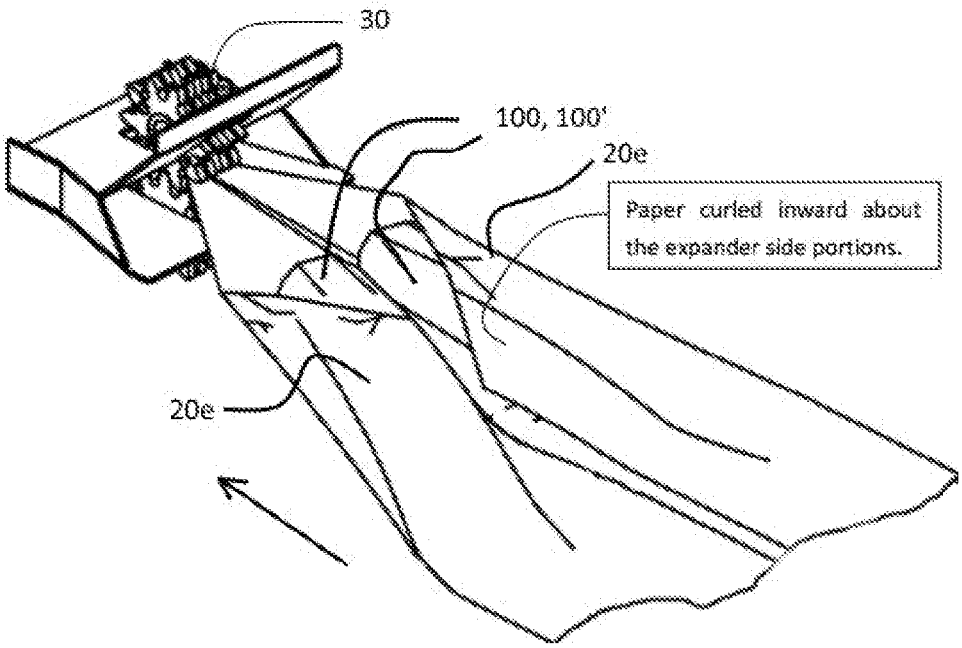
Figure 11C:
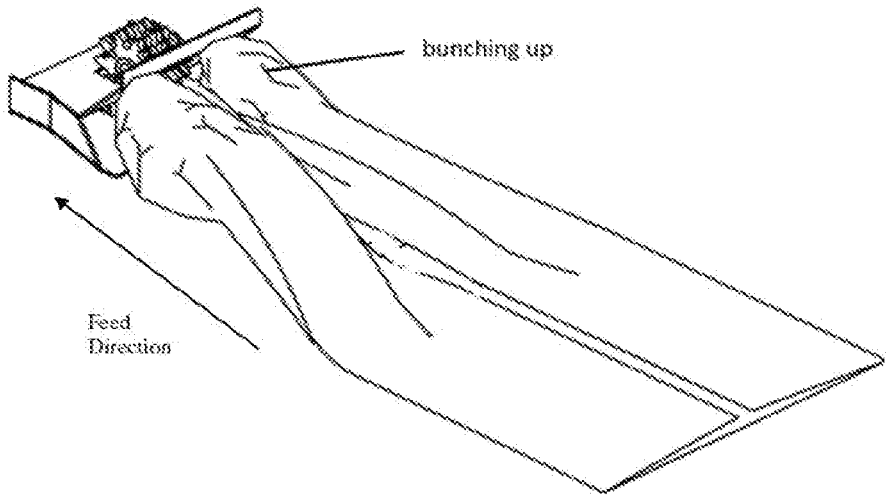
FIG. 11*c* shows an example jammed sheet stock material for various embodiments of the present disclosure with pre-configured sheet stock material having been primed as shown in FIGS. 11*a*-11*b*, but having bunched up near the forming member, such as, for example, when a leading edge of the sheet stock material is not tapered in accordance with various embodiments of the present disclosure, such as those shown in FIGS. 11*a* and 11*b*.
Figure 12:
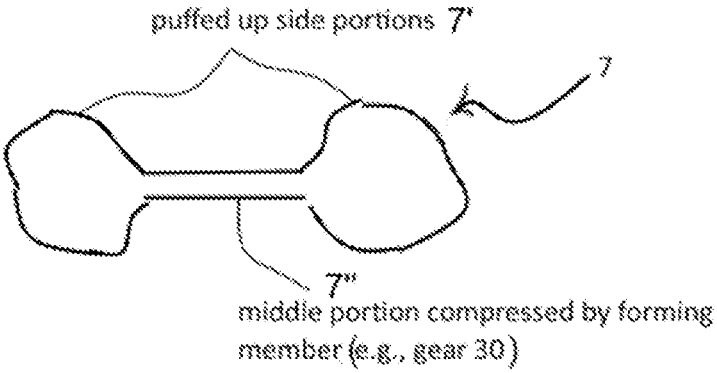
FIG. 12 shows a simplified lateral cross sectional view of a dunnage product (cushioning product) generated using various embodiments of the present disclosure.

Referring to FIGS. 4, 5, 9*b*, and 11*a*, in some embodiments, when the left and right outer sections 20*e* on a beginning section 20*a*' are unfolded and lifted upwardly and laterally outward in the general directions represented by arrows "B" (e.g., FIG. 4), and then wrapped about the expander 100, 100', of the dunnage machine, during priming, as shown in FIGS. 5 & 11*a*, this can assist to volumize the stock sheet material 20 as it is pulled through the dunnage machine so that a final generated paper pad (e.g., dunnage cushioning material) will have longitudinally extending puffed up side portions, such as, for example, as shown in FIG. 12, as will be appreciated by those skilled in the art after reviewing this disclosure. That is, for example, the forming members can serve to compress or stitch the inward portions of the outer sections 20*e* together (as seen in the lateral center region in FIG. 12), while laterally outer portions of the middle section 20*f* and outer sections 20*e* are volumized by saddle portions 104 of the expander 100. The stable puffed outer portions of the resulting dunnage or cushioning material can provide desired cushioning for packages or other containers, as will be appreciated by those skilled in the art after reviewing this disclosure.

In some embodiments of the present disclosure, one or more structures are provided herein to help ensure that once a dunnage machine with pre-former (otherwise referred to herein as an "expander") is primed as discussed above and put into operation, both left and right outer sections 20*e* of the pre-configured (pre folded) stock sheet material remain curled inward around the expander 100 as the stock sheet material 20 is processed/pulled, as shown in FIG. 11*a*, before being compress by the forming gear to form the desired paper pads as shown in FIG. 12. That is, in particular, the inventors hereof have noted that when sheet stock material 20 from stack 20*a* (e.g., FIG. 9*b*) is primed into a dunnage machine as shown in FIG. 11*a*, during operation, the outer sections 20*e* may have a tendency to go "off track," "derail," or otherwise, unwrap partially or fully from about the expander 100 so that the final cushioning product is not formed properly with sufficiently puffed up (volumized) side portions, etc., as shown in the dunnage product 7 in FIG. 12. To facilitate desired operation, various structures and methods are described below.

Figure 13:
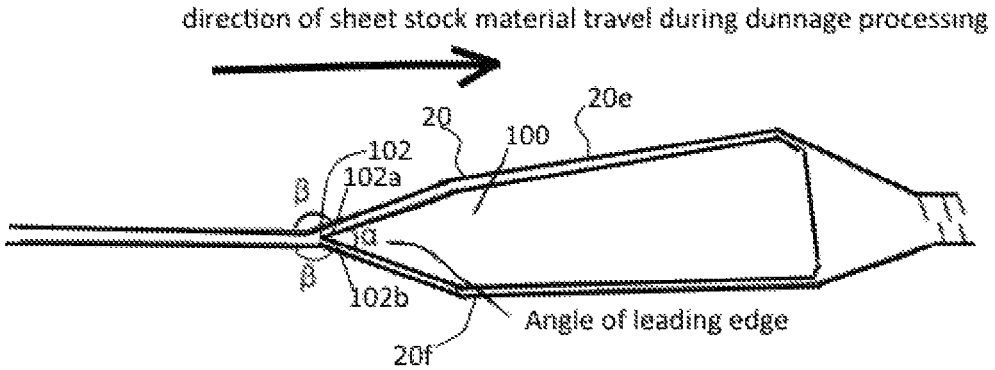
FIG. 13 show a simplified side elevation view of an expander for some embodiments of the present disclosure including a rearwardly tapered leading edge.
Figure 13A:
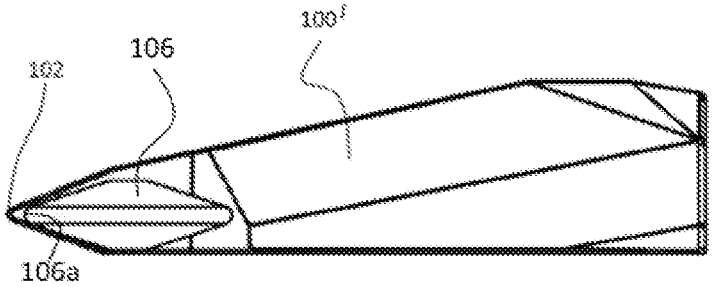
FIG. 13*a* shows a partial side elevation view of an expander having mounted rotatable discs for some embodiments of the present disclosure.

As illustrated in FIGS. 13 & 13*a*, the pre-configured stock sheet material is in a flat configuration (e.g., see each folded layer in FIGS. 2*c* and 9*b*) before entering the expander 100. In some embodiments, during operation after stock sheet material has been primed into the dunnage machine (e.g., wrapped about the expander 100 and connected to the forming member 30), while the forming member 30 is pulling the sheet stock material 20, a leading edge 102 of the expander 100 imparts a force to expand or open up, unfold, the sheet stock material 20 as it passes over the leading edge 102. This leading edge 102 is represented in FIG. 13, showing a simplified side cross section view. An unfolding effect is a function of an angle α at the leading edge of the expander, which is generally an angle between a top outside wall surface 102*a* and lower or bottom outside wall surface 102*b* sloped rearward toward one another to join at the leading edge 102 in a rearwardly tapered fashion. The inventors hereof have found through experimentation that an effective angle α can be within the range of 10 degrees to 120 degrees, 10 degrees to 40 degrees, or 40 degrees to 90 degrees, or 90 degrees to 120 degrees, in some embodiments of the present disclosure. The inventors hereof have found that such angle α can substantially improve system performance compared to some angles outside of this range. After the stock sheet material has been unfolded by being pulled over the leading edge 102 with the angle α by the forming members (e.g., gear 30), and continues to moves onto a forward portion of the expander 100, the upper layer of the paper (e.g., laterally inwardly folded sections 20*e*) and the bottom layer of paper (e.g., middle unfolded section 20*f*) can continue to be vertically separated at corresponding similar or same angle ß, as shown in FIG. 13.

Figure 13B:
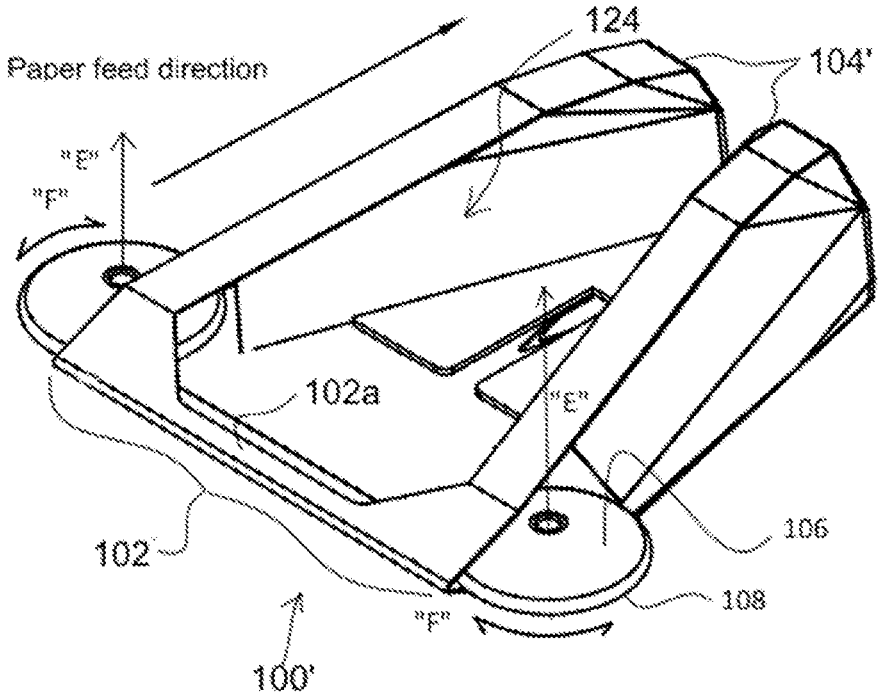
FIG. 13*b* shows a perspective view of the expander of FIG. 13*a*.
Figure 13C:
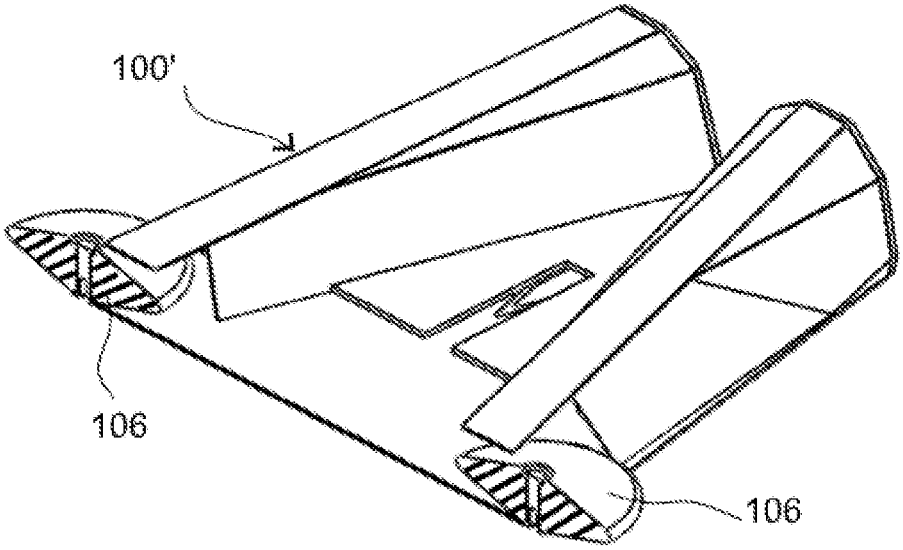
FIG. 13*c* shows the expander of FIG. 13*b*, with a rear portion cut away to expose a lateral cross section of the discs.
Figure 13D:
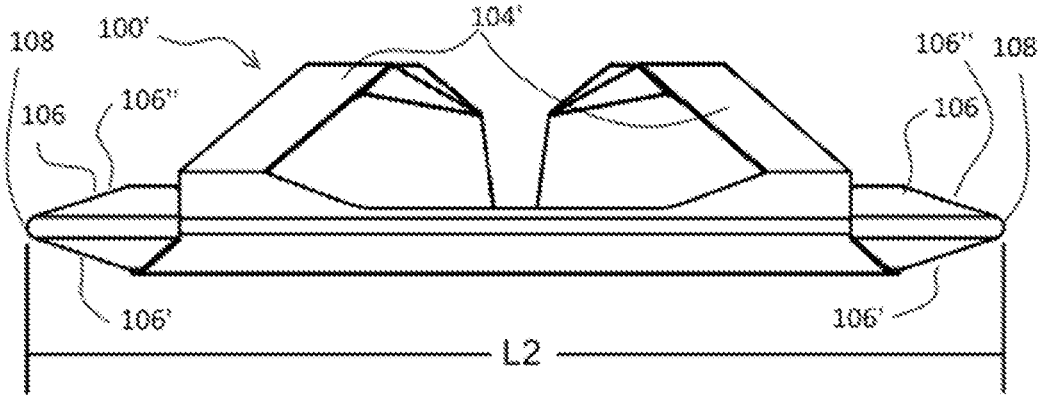
FIG. 13*d* is a rear elevation view of the expander of FIG. 13*b*.

In some embodiments, when pre-configured sheet stock material 20 is fed to a dunnage machine including an expander, the pre-configured sheet stock material 20 having the two outside longitudinal folded lines (e.g., defined by longitudinal perforation lines 20*d*) will travel smoother with outwardly tapered left side and right side edges 108 provided on the expander 100', such as, for example, as illustrated in FIGS. 13*a*-13*d*. That is, for example, in some embodiments, discs 106 are rotatably connected to left and right side edge portions of the expander 100' near a front region thereof. As can be seen in FIG. 13*b*, the discs 106 can be mounted on the expander 100' in a manner to be free to rotate about a center vertical axis "E"," in the directions represented by arrows "F." In some embodiments, the discs rotate about a plane that is parallel to the average direction of travel for the sheet stock material 20 of the expander 100'. As best seen in FIG. 13*d*, the discs 106 have outwardly tapering top walls 106" and bottom walls 106', resolving in a tapered perimeter which forms the right and left side outwardly tapered edges 108 of the expander 100'. When pre-configured sheet stock material 20 travels over the expander 100' with the outer sections 20*e* wrapped over the saddle portions 104', the outwardly tapered edges 108 of the discs 106 can impart a force to facilitate opening of the outer sections 20*e* along the longitudinal fold lines (e.g., which can be perforated longitudinal fold lines, as described herein). In some embodiments outwardly tapered left side and right side edges are provided on the expander without discs 106, such as, for example, as shown in FIGS. 5 & 6, which may also serve a similar purpose as the discs 106, as will be appreciated by those skilled in the art after reviewing this disclosure. Also, in the embodiments of the expander 100' with the discs 106, the discs can rotate freely in the forward direction of arrows "F" shown in FIG. 13*b* to further accommodate smooth progress of the pre-configured sheet stock material. In some embodiments, the positions on which the discs 106 are disposed on the expander 100' are such that rearward edge 106*a* (rearward meaning facing against a direction of sheet stock material flow over the expander) of the discs 106 are proximate the leading edge 102 of the expander 100'. In some embodiments, a longitudinal distance between the rearward edge 106*a* of the discs 106 and the leading edge 102 of the expander is less than about 10 mm, or less than about 20 mm, or less than about 30 mm. As such, the tapered top wall 106" and bottom wall 106' of the discs 106 can assist in opening (unfolding) the pre-configured sheet stock material 20 as it is pulled forward to wrap about the expander 100' with outer sections 20*e* lifting upward to slide over the saddle portions 104 (See, e.g., FIG. 13*d* and FIG. 14).

Referring to FIG. 13*d*, in some embodiments of the present disclosure, a width L2 of the expander 100' as measured from leftmost edge of the left disc 106 to the rightmost edge of the right disc 106 (e.g., distance between the outwardly tapered edges of the discs 106), is less than a maximum width of a pre-configured sheet stock material (e.g., the sheet stock material 20*a* in FIG. 9*b*, or FIG. 14), which may have a width L1 of, for example, 15 inches or about 38.1 cm. In some embodiments, a ratio of a maximum width L2 of the expander divided by a maximum width L1 of the pre-configured sheet stock material being processed in the dunnage machine 30 is between about 0.75 to 0.80, or between about 0.80 to about 0.95.

Figure 14:
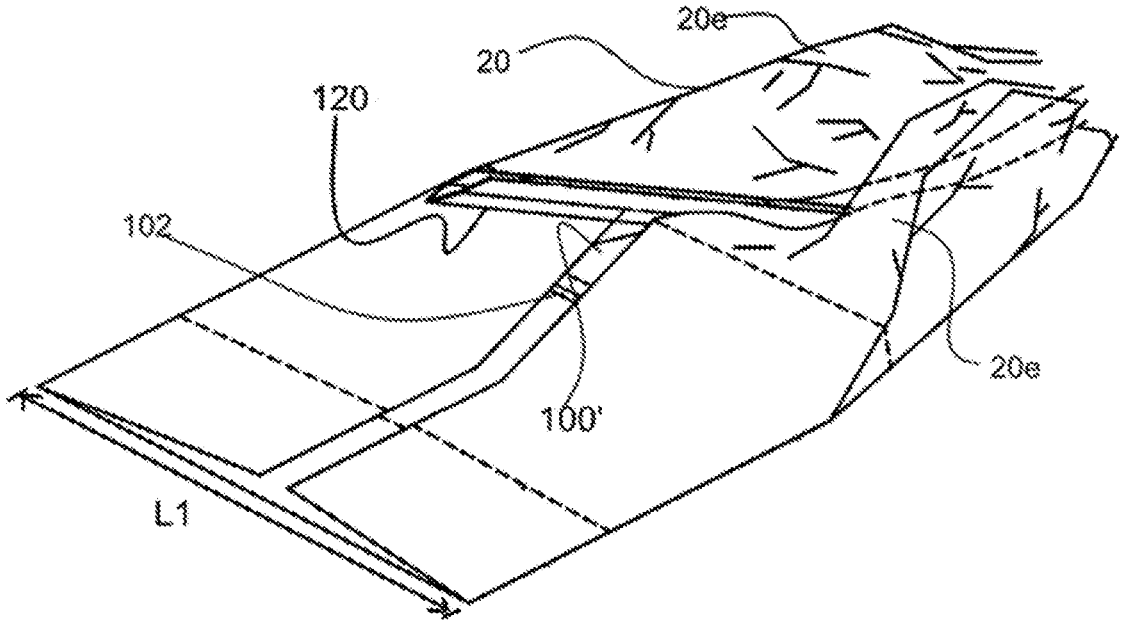
FIG. 14 is a perspective of pre-configured stock sheet material having been primed in accordance with various embodiments of the present disclosure, including wrapped about the expander in FIG. 13*b* and pulled forward by forming members, also showing an upwardly rearwardly sloped separator rod rising from the expander.
Figure 14A:
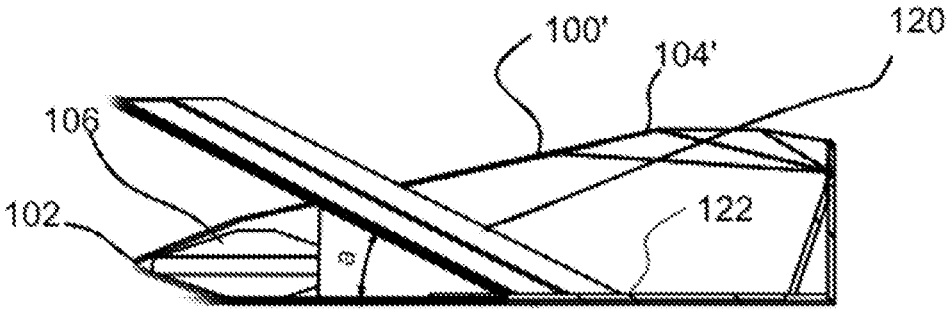
FIG. 14*a* is a side elevation view of the expander of FIG. 13*a*, further including an upwardly rearwardly sloped separator rod in accordance with various embodiments of the present disclosure.

Referring to FIGS. 14 and 14*a*, in some embodiments, an inclined or sloped separator rod 120 is provided and connected to the expander 100'. The sloped separator rode 120 can rise from a sunken surface 122 of the expander 100' situated between the saddle portions 104' thereof. In addition to providing a mounting member for the expander 100' (in some embodiments) the sloped separator rod 120 can also facilitate operation of the expander 100' in assisting outer sections 20*e* of the pre-configured sheet stock material shortly after traveling on the saddle portions 104', to move forward along the expander saddle portions 104' in a "curled in" configuration, to "wrap around" a later portion of the expander saddle portions 104' to help form the dunnage product 7 in the desired shape with stability. If the pre-configured sheet stock material fails to remain sufficiently wrapped about the expander 100' saddle portions 104' in a manner, generally/approximately illustrated in FIG. 14, the dunnage product 7 may not have the puffed up side portions 7', as shown in FIG. 12. For example, as can be seen in FIG. 14*b* showing a simplified lateral cross section of the expander 100' with saddle portions 104', it is desired to have the outer sections 20*e* curl or wrap about the saddle portions 104', with inward portions of the outer sections 20*e* dipping toward a sunken surface 122 between the saddle portions 104', and travel along the expander 100' in this similar manner before reaching the forming member (e.g., gear 30) of the dunnage machine.

Figure 14B:
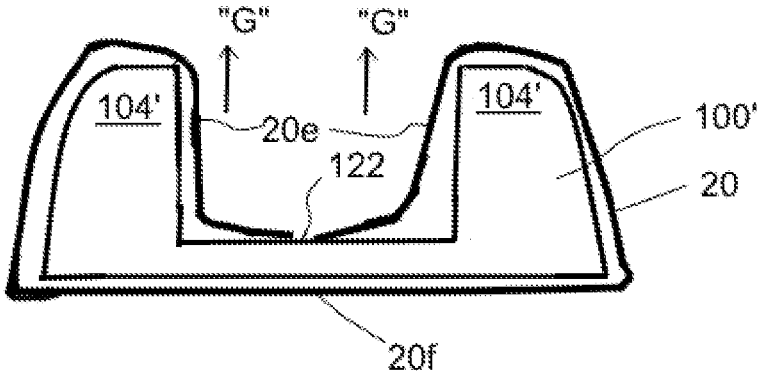
FIG. 14*b* is a simplified lateral cross sectional view of the expander of FIG. 13*b* in use with outer sections of a pre-configured sheet stock material wrapped about saddle portions of the expander, with the arrows "G" showing a tendency of the out sections of the pre-configured sheet stock material to rise off the saddle portions, or derail, but for the assistance of the sloped separator rod as shown in FIGS. 14 and 14*a*.

Still referring to FIG. 14*b*, without the separator rod 120 being sloped in a rising rearward direction, the outer sections 20*e* will have a more frequent and/or stronger tendency to unfold at least partially in the upward direction represented by arrows "G," which will in turn, unwrap or uncurl the pre-configured sheet stock material, or outer sections thereof, from the saddle portions 104' and cause the dunnage product to be poorly formed, or otherwise jam the dunnage machine. In particular, referring again to FIGS. 14 and 14*a*, in some embodiments, a rising longitudinal axis of the separator rod 120 is sloped upwardly rearward (or otherwise stated, downwardly forward) to help the outer sections 20*e* of the sheet stock material 20 moving in forward direction to curl inward about the saddle portions 104'. Moreover, the inventors hereof have determined that a vertically oriented separator rod may cause the outer sections 20*e* to flip "upward" (not desired) or otherwise, unfold laterally outward, instead of curl in, or wrap inwardly downward about the saddle portions 104' of the expander (desired). (See, e.g., FIG. 14*b*). In some embodiments, an angle of rearward slope a, as shown in FIG. 14*a*, measured between an axis (or straight edge) of the sloped separator rod 120, and the sunken surface 122 of the expander 100' or an average plane of sheet stock material travel, is between about ten (10) degrees and seventy-five (75) degrees. In other embodiments, the angle of rearward slope is greater than seventy-five (75) degrees or less than ten (10) degrees.

Figure 15:
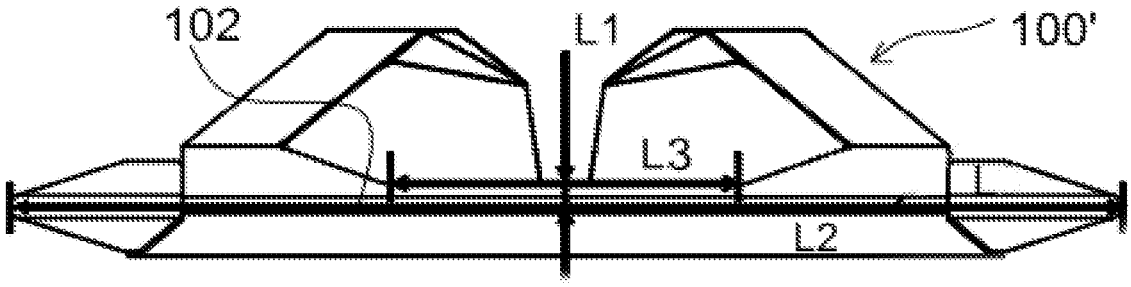
FIG. 15 is a rear elevation view of the expander in FIG. 13*b*, including dimensional marks L1, L2 and L3 as further described herein.

Referring to FIG. 13*b*, in some embodiments, at the central portion of the expander 100', just forward of a leading edge 102 of the expander, an opening pit or sunken region 124 is provided, defined by the sunken surface 122. Rearward of the sunken region, defining a reward perimeter thereof, is a top wall of the leading edge 102 of the expander 100', having a top outside wall surface 102*a*. In some embodiments, a vertical distance, or height L1, that the top outside wall surface 102*a* rises above the leading edge 102 (or a vertical center of the leading edge 102) is between about 5 mm-20 mm, or is less than about 60 mm (See, e.g., FIG. 15). In some embodiments, the height L1 is less than about 20% of maximum width of pre-configured sheet stock material being processed in the dunnage machine.

In some embodiments, a maximum width L3 of the sunken region 124, is a configured to be approximately between 20% (⅕th) to about 80% (⅘th) of the maximum width L2 of the expander 100'.

Figure 16A:
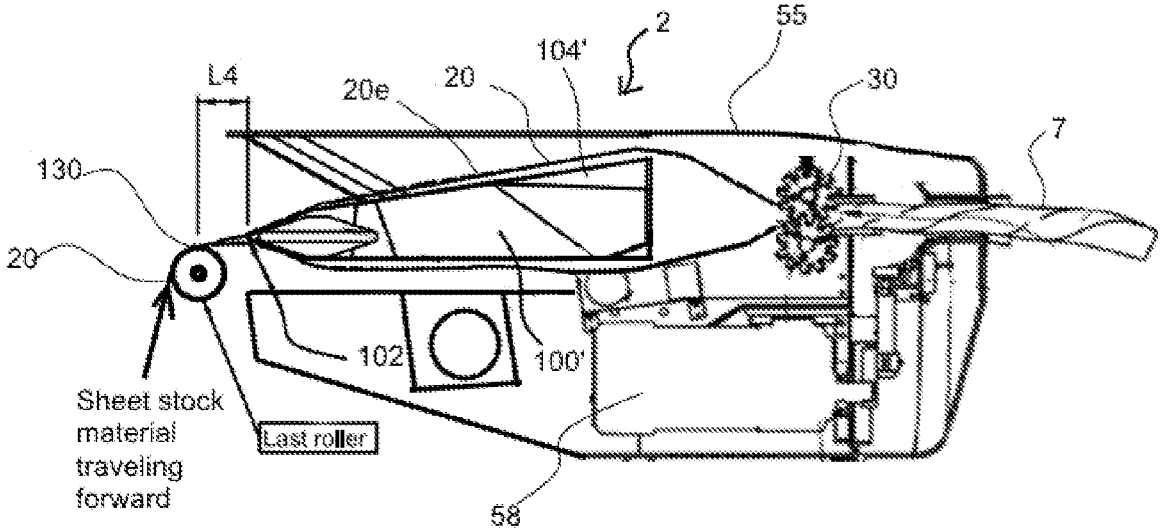
FIGS. 16*a* and 16*b* are simplified cutaway side elevation views of a dunnage system of the present disclosure.
Figure 16B:
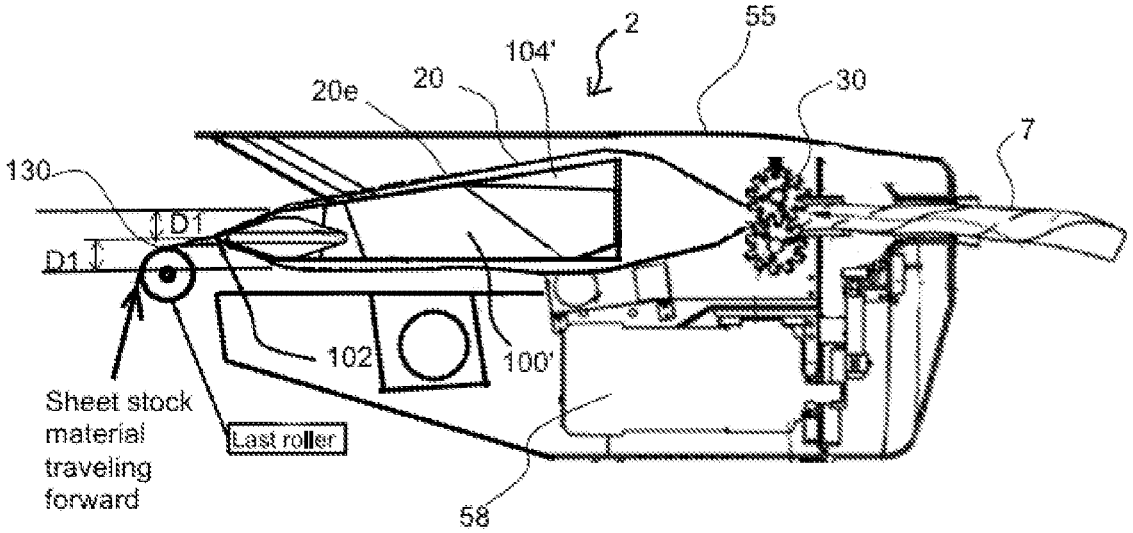

As will be appreciated by those skilled in the art upon reviewing this disclosure, dunnage systems 2 commonly employ rollers for guiding sheet stock material from a feed tray or stock roll location at which fanfold stacks, or papers rolls, are placed or held, to feed stock sheet material to the dunnage machine. Referring to FIGS. 16*a* and 16*b*, a dunnage system 2 is shown, having at least one roller, which may be a last roller in a series of one or more rollers for guiding sheet stock material from a stock sheet supply unit (e.g., pre-configured fanfold stack of multi-ply or single-ply paper), and a dunnage machine 55 comprising an expander 100', a motor unit 58 for driving a forming member 30 (e.g., gears), among other things, as will be appreciated by those skilled in the art after reviewing the present disclosure. A final contact location 130 is defined as a location where the pre-configured stock sheet material of the present disclosure contacts a "last roller" (last paper roller in a feed system) before interacting with the expander 100'. As the sheet stock material travels forward to the expander 100' from the final contact location 130, the sheet stock material 20 is in a "free state" with various degrees of freedom for movement, so there is risk it will not align properly with the leading edge 102 of the expander 100' to properly unfold the outer section 20*e* so they ride onto and curl about the saddle portions 104'. Improper alignment can cause the sheet stock material 20 to jam, or not otherwise properly form the dunnage product 7 in FIG. 12. To address the alignment matter and increase stable operation of the dunnage machine using pre-configured stock sheet material with expander 100', within a dunnage system 2 of FIG. 16*a*, the dunnage system 2 can be configured such that a distance L4 between the final contact location 130 and the leading edge 102, is less than about 150 mm. In some embodiments, L4 is less than about 200 mm.

Also, referring to FIG. 16*b*, in some embodiments, the dunnage system 2 is configured such that the final contact location 130 and the leading edge 102 of the expander should generally rest within a single horizontal plane to facilitate effective sheet stock material travel over the expander 100' to generate dunnage product 7. In some embodiments, a differential height vertical height D1 between the leading edge 102 and the final contact location 130 should be less than about 40 mm.

As will be appreciated by those skilled in the art after reviewing the present disclosure, various aspects of the present disclosure, including the modified beginning and finishing sections, the stacking or otherwise coupling of pre-configured stock supply units (e.g., fanfold stacks) formed from multi-directional perforated stock sheet material using the modified beginning and/or finishing sections, the use of tapered leading edge portions for the pre-configured stock sheet material, the loading of the pre-configured stock sheet material by lifting the pre-folded outer sections (e.g., pre-configured) at a leading portion of the stock sheet supply unit and wrapping them about a pre-former (e.g., expander 100'), and the various structural features disclosed herein for the expander, dunnage system, and dunnage machine, may be combined in a dunnage system or method of operating a dunnage system or machine, or in a stock sheet supply unit. Alternatively, one or more of those various aspects described herein may be used separately or together with one or more of the other various aspects described herein.

After reviewing the present disclosure, an individual of ordinary skill in the art will immediately appreciate that some details and features can be added, removed and/or changed without deviating from the spirit of the invention. Reference throughout this specification to "one embodiment," "an embodiment," "additional embodiment(s)" or "some embodiments," or variations thereof, means that a particular feature, structure or characteristic described in connection with the embodiment(s) is included in at least one or some embodiment(s), but not necessarily all embodiments, such that the references do not necessarily refer to the same embodiment(s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

What is claimed is:

1. A supply unit of pre-configured sheet stock material for a dunnage machine comprising:
- at least one middle longitudinal section;
- a first laterally folded longitudinal section; and
- a second laterally folded longitudinal section,
- wherein a beginning section or finishing section of the supply unit comprises the first and second laterally folded longitudinal sections extending longitudinally further than the at least one middle longitudinal section or the at least one middle longitudinal section extending longitudinally further than the first and second laterally folded longitudinal sections, and
- wherein both the first laterally folded longitudinal section and the second laterally folded longitudinal section each include a folded leading edge portion folded in a longitudinal direction.

2. The supply unit of claim 1 wherein the supply unit is a fanfold stack of sheet stock material.

3. The supply unit of claim 1 wherein the at least one middle longitudinal section includes a cut extending widthwise along a leading edge or trailing edge thereof, truncating the middle longitudinal section relative to the first and second laterally folded longitudinal sections.

4. The supply unit of claim 1 wherein the folded leading edge portions of the longitudinal sections each form a portion of a triangular shaped larger folded portion that includes a portion of the at least one middle longitudinal section.

5. The supply unit of claim 1 wherein the first and second laterally folded longitudinal sections extend longitudinally further than the at least one middle longitudinal section at a first end portion of the supply unit and the at least one middle longitudinal section extending longitudinally further than the first and second laterally folded longitudinal section at a second end portion of the supply unit.

6. The supply unit of claim 1 wherein the beginning section includes a tapered leading edge.

7. The supply unit of claim 1 further comprising adhesive disposed on at least one of the beginning section and finishing section.

8. A supply unit of pre-configured sheet stock material for a dunnage machine comprising:
- an end fold section including:
  - a trailing fold edge;
  - a middle longitudinal section having a first leading edge spaced apart from the trailing fold edge by a first dimension in a longitudinal direction;
  - a first laterally folded longitudinal section integral with the middle longitudinal section, the first laterally folded longitudinal section having a second leading edge, the first laterally folded longitudinal section overlaps the middle longitudinal section in a lateral direction transverse to the longitudinal direction, the second leading edge spaced apart from the trailing fold edge by a second dimension in the longitudinal direction, the second dimension being different from the first dimension; and
  - a second laterally folded longitudinal section integral the middle longitudinal section, the second laterally folded section having a third leading edge, the second laterally folded longitudinal section overlaps the middle longitudinal section in the lateral direction, the third leading edge spaced apart from the trailing fold edge by a third dimension in the longitudinal direction, the third dimension being different from the first dimension.

9. The supply unit of claim 8 wherein the first dimension is greater than the second dimension.

10. The supply unit of claim 8 wherein the second dimension is greater than the first dimension.

11. The supply unit of claim 8 wherein the third dimension is equal to the second dimension.

12. The supply unit of claim 11 wherein the second dimension and the third dimension are greater than the first dimension.

13. The supply unit of claim 12 wherein:
- the first laterally folded longitudinal section having a first folded leading edge portion folded in the longitudinal direction; and
- the second laterally folded longitudinal section having a second folded leading edge portion folded in the longitudinal direction.

14. The supply unit of claim 11 wherein the second dimension and the third dimension are less than the first dimension.

15. The supply unit of claim 14 wherein:
- the first laterally folded longitudinal section having a first folded leading edge portion folded in a longitudinal direction; and
- the second laterally folded longitudinal section having a second folded leading edge portion folded in the longitudinal direction.

16. The supply unit of claim 8 wherein the second dimension and the third dimension are different from each other.

17. The supply unit of claim 16 wherein:

the first laterally folded longitudinal section having a first folded leading edge portion folded in a longitudinal direction; and the second laterally folded longitudinal section having a second folded leading edge portion folded in the longitudinal direction.

18. The supply unit of claim 8 wherein the first laterally folded longitudinal section has a first leading edge portion folded in a longitudinal direction.

19. The supply unit of claim 8 wherein:

the first laterally folded longitudinal section having a first folded leading edge portion folded in a longitudinal direction; and the second laterally folded longitudinal section having a second folded leading edge portion folded in the longitudinal direction.

* * * * *